US010648765B2

(12) United States Patent
Miller et al.

(10) Patent No.: US 10,648,765 B2
(45) Date of Patent: May 12, 2020

(54) HIGH CAPACITY MAGAZINE FOR SPHERICAL PROJECTILES

(71) Applicant: Hasbro, Inc., Pawtucket, RI (US)

(72) Inventors: Christopher Miller, Tarrytown, NY (US); Robert James Victor, New York, NY (US); William J Bryant, Dayton, OH (US); David Michael Nugent, Newport, RI (US)

(73) Assignee: HASBRO, INC., Pawtucket, RI (US)

( * ) Notice: Subject to any disclaimer, the term of this patent is extended or adjusted under 35 U.S.C. 154(b) by 0 days.

(21) Appl. No.: 16/218,224

(22) Filed: Dec. 12, 2018

(65) Prior Publication Data

US 2019/0204041 A1 Jul. 4, 2019

Related U.S. Application Data

(60) Provisional application No. 62/611,802, filed on Dec. 29, 2017.

(51) Int. Cl.

| | |
|---|---|
| ***F41A 9/61*** | (2006.01) |
| ***F41B 7/00*** | (2006.01) |
| ***F41B 7/08*** | (2006.01) |
| ***F41A 9/75*** | (2006.01) |

(52) U.S. Cl.
CPC ..... *F41B 7/006* (2013.01); *F41A 9/75* (2013.01); *F41B 7/08* (2013.01)

(58) Field of Classification Search
CPC ..... F41B 7/006; F41B 7/08; F41A 9/75
USPC ..... 89/33.02, 33.17; 124/45, 48, 51.1, 52
See application file for complete search history.

(56) References Cited

U.S. PATENT DOCUMENTS

| | | | | |
|---|---|---|---|---|
| 409,017 | A | 8/1889 | Comstock | |
| 522,464 | A | 7/1894 | Fox | |
| 532,090 | A | 1/1895 | Park | |
| 961,511 | A | 6/1910 | Marble | |
| 3,465,744 | A | 9/1969 | Nielsen | |
| 4,384,508 | A | 5/1983 | Sullivan et al. | |
| 4,558,626 | A | 12/1985 | Bartolles | |
| 4,774,929 | A | 10/1988 | Milliman | |
| 5,529,050 | A | 6/1996 | D'Andrade | |
| 6,109,252 | A | 8/2000 | Stevens | |
| 6,598,329 | B1 | 7/2003 | Alexander | |
| 7,222,617 | B2 * | 5/2007 | Andresen | F41A 9/02 124/48 |
| 7,287,526 | B1 | 10/2007 | Bligh et al. | |
| 7,357,130 | B2 * | 4/2008 | Broersma | F41A 9/02 124/51.1 |
| 7,418,797 | B1 | 9/2008 | Crose | |
| 7,437,847 | B1 | 10/2008 | Mabry | |
| 7,552,557 | B1 | 6/2009 | Mabry | |

(Continued)

*Primary Examiner* — Nini F Legesse
(74) *Attorney, Agent, or Firm* — Perry Hoffman

(57) ABSTRACT

A large capacity magazine apparatus for spherical projectiles, such as toy foam balls that may be used in conjunction with a launcher. The magazine includes drum and clip housings and a rotatable sprocket with longitudinal flutes that together form a smooth pathway for the foam balls to travel in the magazine and to alleviate jams. The smooth pathway includes a helical path, a transition path and a linear path within the housings. A constant force spring provides a rotational force for the sprocket and a plurality of articulated rigid balls function to push the foam balls out of the magazine and into a firing chamber of the launcher.

25 Claims, 22 Drawing Sheets

(56) References Cited

U.S. PATENT DOCUMENTS

| | | | | |
|---|---|---|---|---|
| 7,568,478 | B2 * | 8/2009 | Hedberg | F41B 11/53<br>124/51.1 |
| 8,402,958 | B2 * | 3/2013 | Victor | F41B 4/00<br>124/45 |

* cited by examiner

HIGH CAPACITY MAGAZINE FOR SPHERICAL PROJECTILES

FIELD OF THE INVENTION

The present invention relates to a high capacity magazine apparatus, and more particularly, to a high capacity magazine apparatus for spherical projectiles such as toy foam balls.

BACKGROUND OF THE INVENTION

Earlier patents concerning magazines or container for spherical projectiles include U.S. Pat. Nos. 6,109,252; 7,222,617; 7,357,130; and 8,402,958. For example, U.S. Pat. No. 6,109,252 issued to Stevens in 2000 and entitled "Projectile Feed System" purports to disclose an apparatus 2 having a casing 4 for storing and feeding paint balls 42 to a paint ball gun 72. Paint balls 42 are received in pockets 40 around the periphery of a carrier 20. Rotation by a motor 10 of the carrier 20 moves the paint balls 42 into contact with a stationary guide bar 26 and a squash plate 30 to move the paint balls 42 from the pockets 40 and into an outlet 8 of the apparatus. A stationary guide disc 22 is mounted above the carrier 20, the guide disc 22 having a plurality of guide recesses 50 which are aligned above the pockets 40 to cause the paintballs to move from the recesses to the pockets.

U.S. Pat. No. 7,222,617 issued in 2007 to Andresen and entitled "Device For Storing Projectile Balls And Feeding Them Into The Projectile Chamber Of A Hand Gun" purports to disclose a container 3 for paintballs 14 that are feed to a user with a gun. At the bottom of the container is a feeder 8 having peripheral chambers 11 for receiving the paintballs 14 and directing them to a discharge canal 9 that connects to the gun. A motor and a slip clutch 17, 18, 19 provide just enough pressure to move the paintballs without causing the paintballs to rupture.

A year later U.S. Pat. No. 7,357,130 issued to Broersma with the title "Spring-Assisted Paintball Loader." The Broersma patent purports to disclose a paddle wheel spool 5 consisting of a paddle 9 projecting radially in the middle of a circular well 4 located in the lowest region of a projectile magazine 3. The paddle is always pushing against a row of paintballs 2, and an intake 6 for a duct 7 leads to a gun. Spinning of the spool 5 is momentarily driven by an electrical motor 11 and includes springs 20, 21 that remains under tension when the motor is de-energized, the springs used for applying enough pressure through the paddle 9 against a row of paintballs, as shown in FIG. 1. Instead of the spool and paddles, a spiral spring 27 with arms 30, 31 may be substituted.

U.S. Pat. No. 8,402,958 issued to Victor and others in 2013 and entitled "Toy Dart Magazine Apparatus" purports to disclose a toy dart magazine 10 for foam darts including a drum portion 20 and a mounted clip portion 26. Within the drum portion are peripheral rim portions 110, 112 having recesses 30, 32 for carrying the darts. There is also a constant force spring 40 and a flexible arm 44 that together extend into the clip portion and also around the drum portions to keep a generally constant biasing force on the darts as the darts are loaded into an empty clip portion 26 and then into an empty drum portion 20 as shown in FIGS. 13-16, resulting in a fully loaded magazine (both clip and drum portions) shown in FIG. 8. The dart magazine is inserted into a toy launcher, and as the launcher is fired, the constant force spring and the flexible arm move the loaded darts through the drum portion and into the clip portion to feed the launcher.

SUMMARY OF THE INVENTION

The present invention is a high capacity magazine for soft or flexible spherical projectiles that aims to alleviate jams, is easy to use and is compact and rugged. The capacity of the magazine is easily scaled up or down and is especially suited for storing and feeding toy foam balls used by toy launchers already marketed by Hasbro Inc., under the brand RIVAL.

Briefly summarized, the invention is of a high capacity magazine apparatus for flexible spherical projectiles including a generally hollow cylindrical housing having front and rear end portions and a shell forming helical and transition paths for flexible spherical projectiles to follow, a delivery and storage cylinder having multiple recesses extending parallel to a longitudinal axis of the delivery cylinder, the delivery cylinder being rotatably mounted in the hollow housing wherein flexible spherical projectiles are enabled to move along the recesses of the delivery cylinder and the paths of the shell of the hollow housing from the rear end portion to the front end portion of the hollow housing, an elongated tubular housing mounted to the hollow housing, the tubular housing having an internal path for flexible spherical projectiles to enable movement of the spherical projectiles from the hollow housing to a launcher of spherical projectiles, a structure mounted to the hollow housing and connected to the delivery cylinder to enable the delivery cylinder to rotate, and a pusher having a surface of less flexibility than the flexible spherical projectiles movable along the helical, transition and internal paths to enable the flexible spherical projectiles to exit the tubular cylinder.

The present invention also includes a method for making a high capacity magazine apparatus for flexible spherical projectiles including the steps of forming a generally hollow cylindrical housing having front and rear end portions and a helically shaped shell for forming helical and transition paths for resilient spherical projectiles to follow, rotatably mounting a fluted delivery cylinder in the hollow housing, wherein flexible spherical projectiles moving between the front and rear end portions of the hollow housing are enabled to move along longitudinally directed flutes of the delivery cylinder, connecting an elongated clip housing to the front end portion of the hollow housing, the clip housing having an internal path for spherical projectiles to enable movement of the spherical projectiles from the hollow housing to a launcher of spherical projectiles, mounting a structure to the delivery cylinder to enable the delivery cylinder to rotate, and mounting a pusher having a surface of less resilience than the spherical projectiles, the pusher being movable along the helical, transition and internal paths to enable spherical projectiles to exit the elongated cylinder.

The invention here, described below in connection with the illustrated embodiments, offers a combination that has good play value. The features and advantages of the present invention will be explained in, or become apparent from, the following description of the preferred embodiments considered together with the accompanying drawings.

BRIEF DESCRIPTION OF THE DRAWINGS

For the purpose of facilitating an understanding of the invention, the accompanying drawings and detailed description illustrate preferred embodiments thereof, from which the invention, its structures, its construction and operation, its processes, and many related advantages may be readily understood and appreciated.

DESCRIPTION OF THE PREFERRED EMBODIMENTS

The following description is provided to enable those skilled in the art to make and use the described embodiments set forth in the best mode contemplated for carrying out the invention. Various modifications, equivalents, variations, and alternatives will become readily apparent to those skilled in the art. Any and all such modifications, variations, equivalents, and alternatives are intended to fall within the spirit and scope of the present invention.

Figure 1:
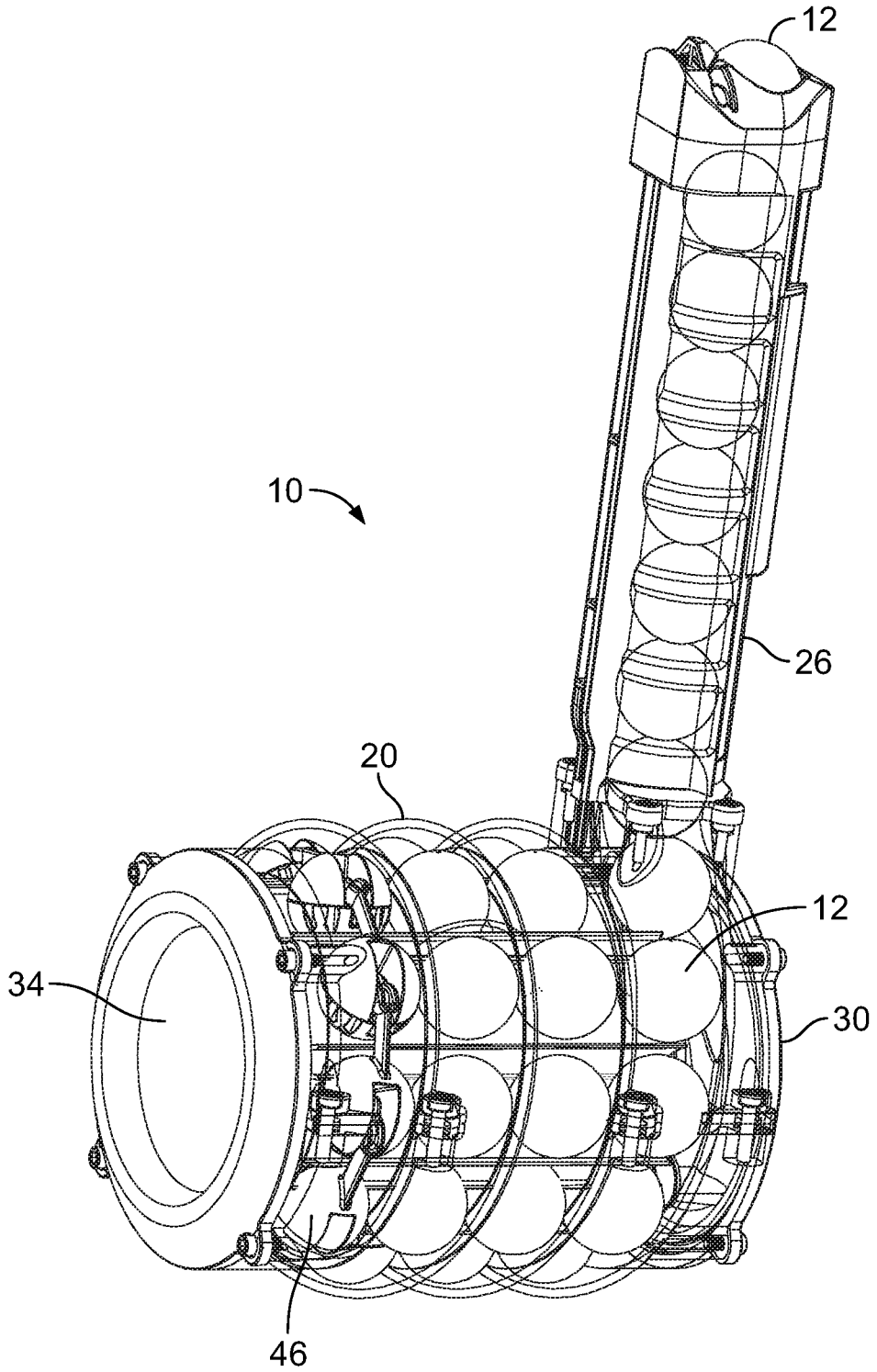
FIG. 1 is an isometric view of a preferred embodiment of the present invention in the form of a drum type magazine for spherical projectiles, the magazine being shown fully with foam balls.
Figure 2:
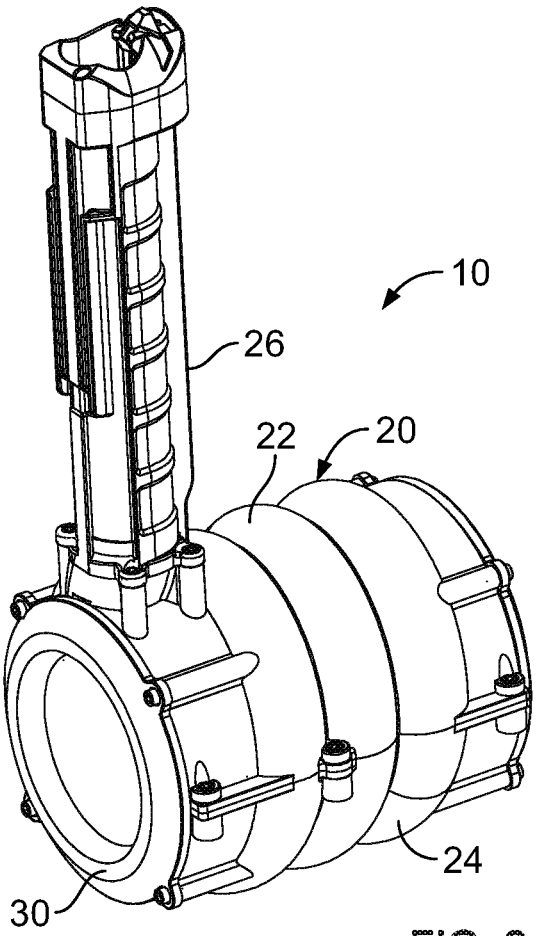
FIG. 2 is an isometric view of the magazine shown in FIG. 1, after being rotated about 180°.
Figure 3:
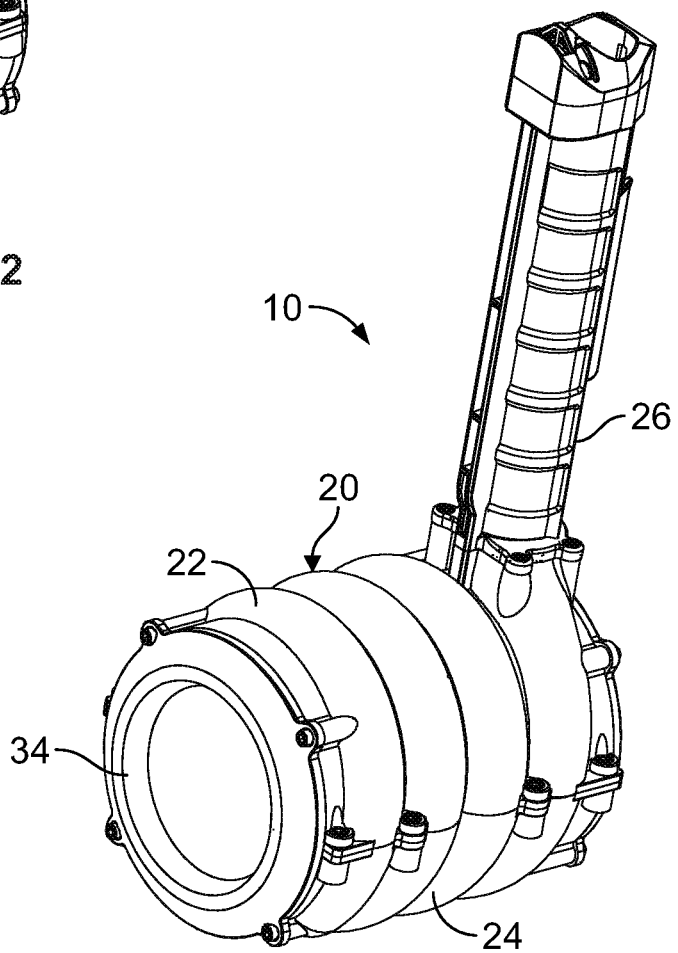
FIG. 3 is an isometric view of the magazine shown in FIG. 1, in an empty configuration.
Figure 5:
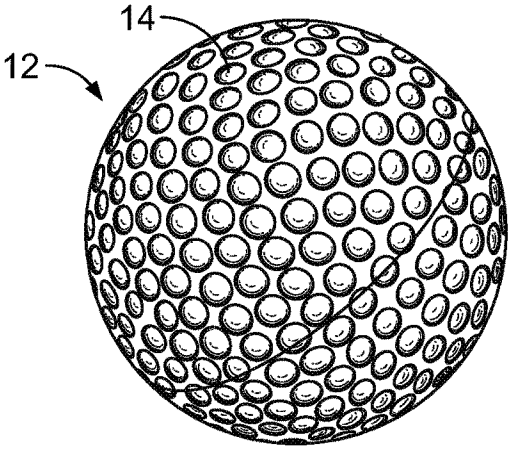
FIG. 5 is an enlarged isometric view of a foam ball of the type loaded in the magazine shown in FIG. 1.
Figure 4:
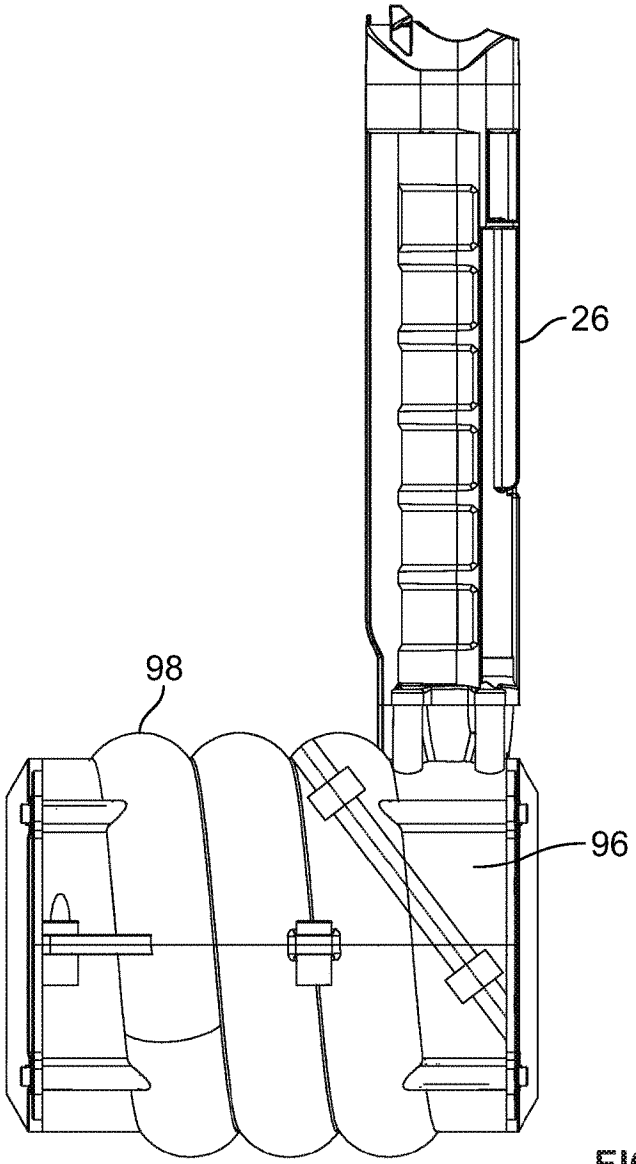
FIG. 4 is an elevation view of a modified drum type magazine.

Referring to FIGS. 1-6, there is illustrated an embodiment of the present invention in the form of a magazine apparatus 10 for spherical projectiles illustrated in FIG. 1, as fully loaded and transparent, and in an unloaded configuration in FIGS. 2 and 3. In the embodiment described in detail here, when spherical projectiles are mentioned, reference is made to soft foam balls or rounds 12, FIG. 5, marketed by Hasbro, Inc., under the trademark NERF®. The foam balls 12 may each have a diameter range of about 22.5 to about 23.5 mm and a hardness of about 1.5 to 2.1 Kg or less than 55 Durometer Shore A. The surface 14 of the foam ball 12 may be dimpled, much like a golf ball, for improved flight characteristics. The foam balls are stored in and fed from the magazine, and may be launched from Hasbro brand launchers, such as the commercially available launchers sold under the brand Nerf Rival Apollo XV700™.

In the alternative, the magazine may be enlarged and used to store and feed other spherical projectiles, such as paint balls.

Figure 6:
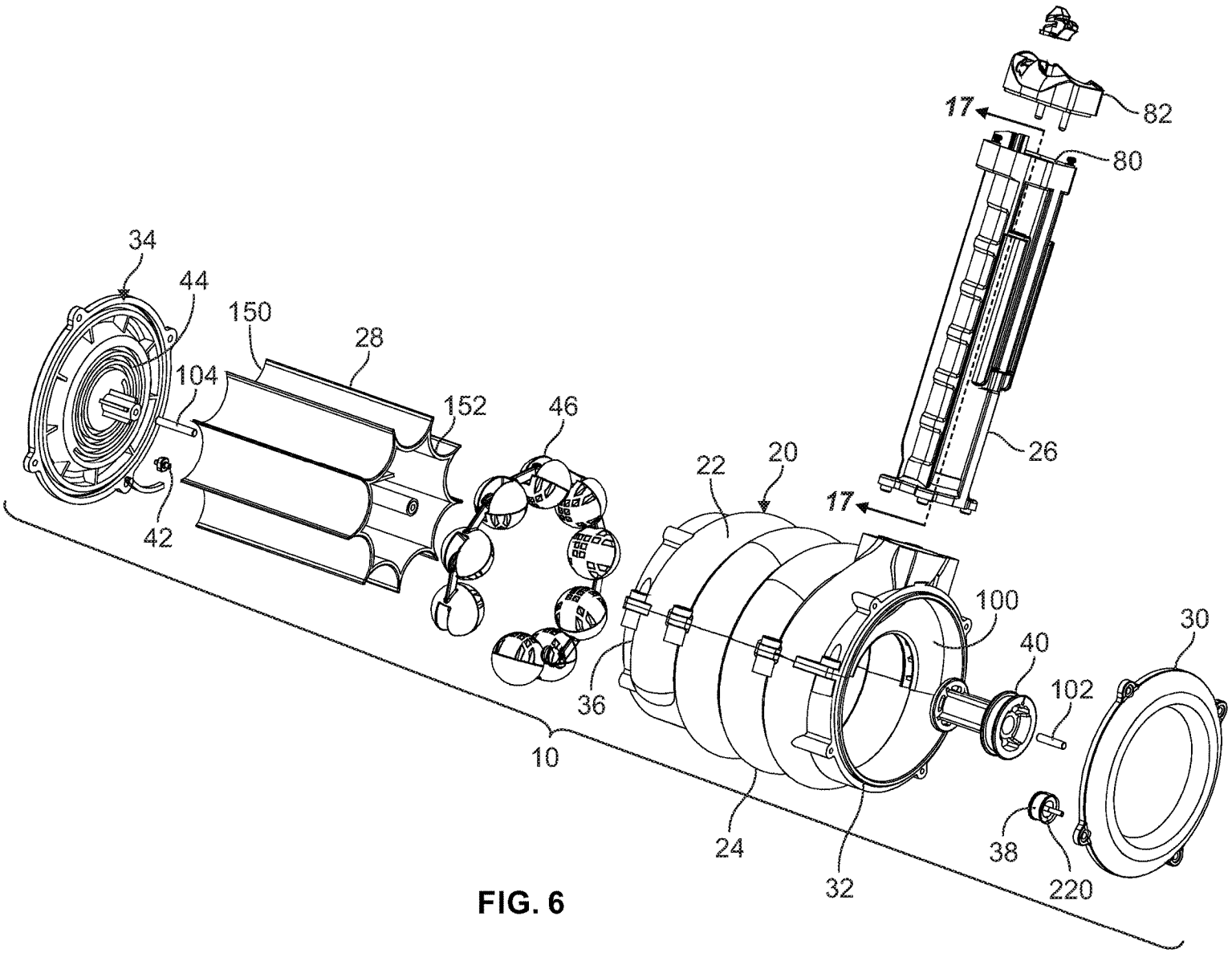
FIG. 6 is an exploded isometric view of the magazine shown in FIGS. 1-3.

The main components of the magazine 10, FIG. 6, include a first housing in the form of the hollow cylindrical housing 20 divided into upper and lower parts 22 and 24, respectively, and a second housing in the form of the elongated tubular housing 26. The first housing 20 will be referred to as the drum housing 20 and the second housing 26 will be referred to as the clip housing 26. The clip housing 26 may be mounted to the drum housing 20 and the magazine may include an armature-like fluted delivery and storage cylinder 28 rotatably mounted within the drum housing 20. The magazine 10 may also include a front cover 30 mounted to a front end portion 32 of the drum housing 20, a rear cover 34 mounted to a rear end portion 36 of the drum housing 20, a structure to enable the delivery and storage cylinder 28 to rotate in the form of a constant force spring 38 mounted to the front cover 30, a pulley 40 mounted to the delivery and storage cylinder 28 and connected to the constant force spring 38, a slider 42 mounted to the delivery and storage cylinder 28 and enabled to engage a spiral groove 44 in the rear cover 34, and a pusher in the form of a plurality of articulated rigid structures 46, called the pusher balls for convenience, movable back and forth along the drum and clip housings 20, 26 and along the delivery cylinder 28 for pushing loaded foam balls out of the magazine.

Figure 9:
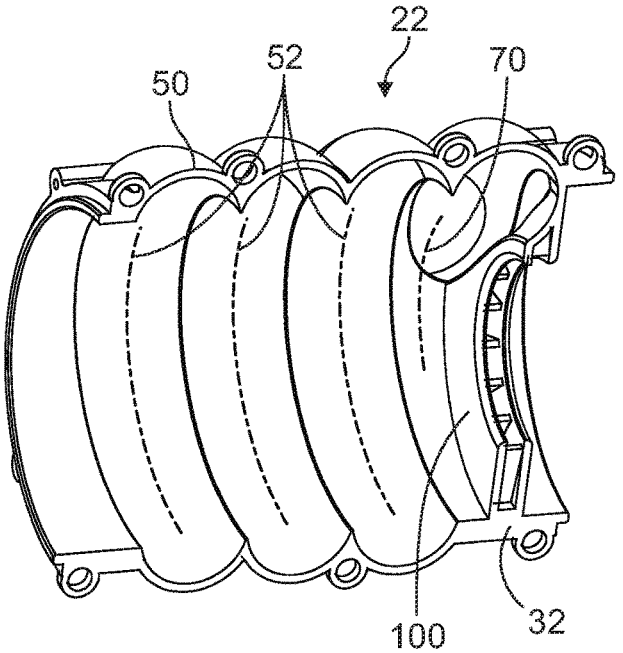
FIG. 9 is an isometric view of the interior of the upper part of the drum housing shown in FIGS. 7 and 8 and illustrating a foam ball centerline path.
Figure 10:
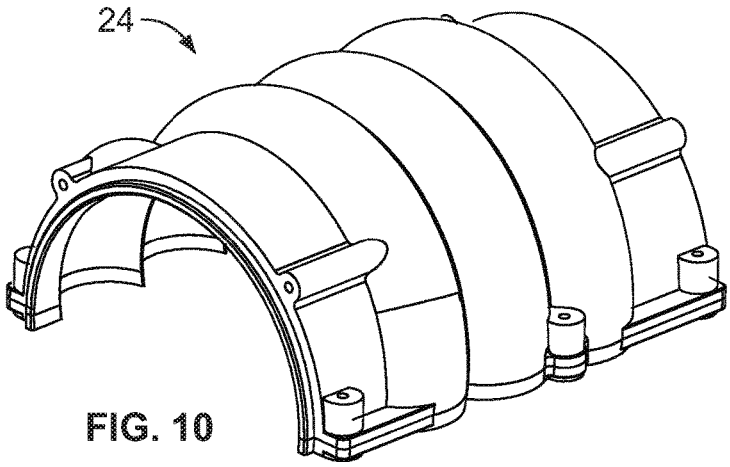
FIG. 10 is an isometric view of a lower part of the drum housing shown in FIGS. 1-3.
Figure 11:
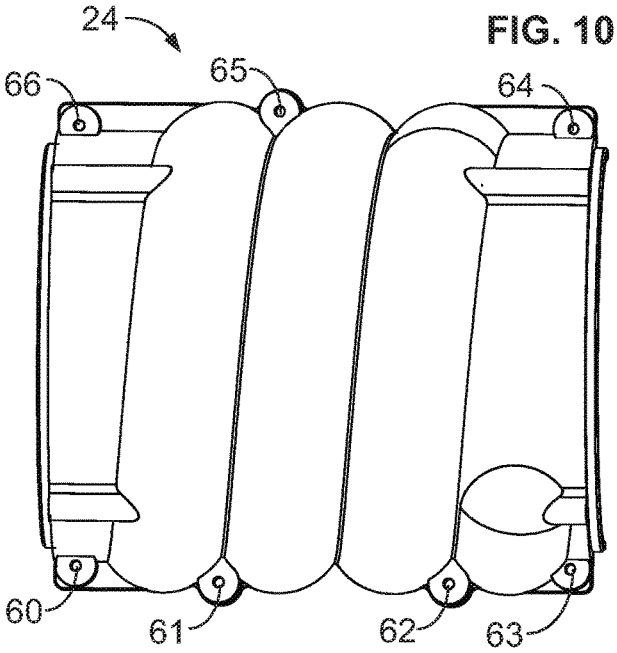
FIG. 11 is a bottom plan view of the lower part of the drum housing shown in FIG. 10.
Figure 12:
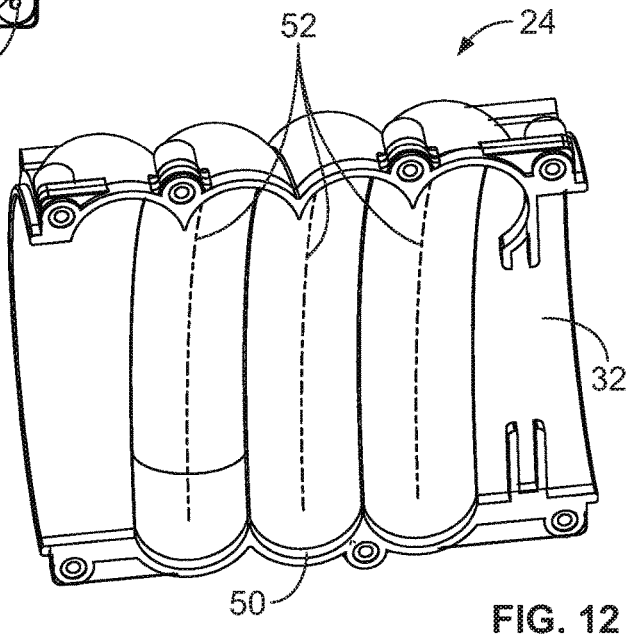
FIG. 12 is an isometric view of the interior of the lower part of the drum housing shown in FIGS. 10 and 11, and illustrating the foam ball centerline path.

The drum housing 20, FIGS. 7-12, is compact and rugged and functions as a container for the foam balls 12 as well as a feeding mechanism. The upper and lower parts 22, 24 of the drum housing 20 may be constructed of transparent plastic to allow an operator to easily determine the number of foam ball 12 remaining in the housing. As shown in FIGS. 7-12, the shell 50 of the drum housing 20 is formed to create a helical path symbolized by a foam ball centerline 52, FIGS. 9 and 12, illustrating the pathway of a foam ball as it moves from the rear end portion 36 of the drum housing 20, when the magazine is fully loaded, to the front end portion 32 of the drum housing 20.

Figure 13:
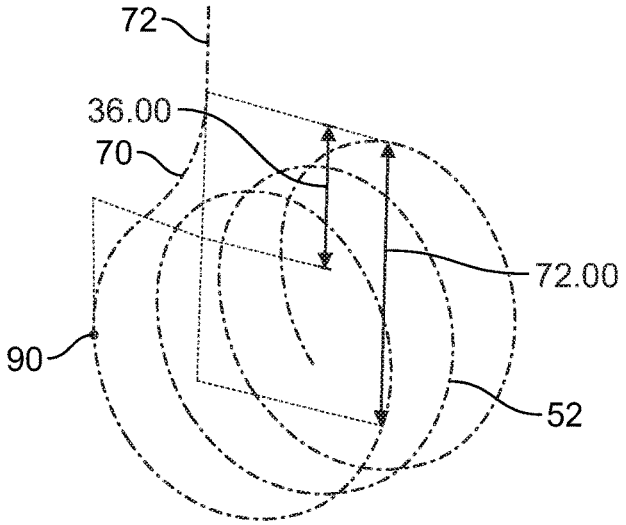
FIG. 13 is a diagrammatic isometric view of a centerline path that a foam ball travels as the ball is fed through the magazine shown in FIGS. 1-3, and illustrating a start point of a transition portion of the path.

The upper and lower plastic shells 22, 24 of the drum housing 20 may have seven fastener openings 60, 61, 62, 63, 64, 65, 66 for receiving fasteners to attach the two shells together. At the front end portion 32 of the drum housing 20, the helical path 52 changes to a transition path 70, FIG. 9, to be described in detail below, causing the foam balls 12 to change direction from the helical path 52 to a generally internal or linear path 72, FIGS. 7 and 13, the linear path 72 being defined by the clip housing 26, FIG. 17. It is important that the soft foam balls be able to change from one path to another smoothly to avoid jamming caused when the foam balls distort because a foam ball catches on or is squeezed by components of the magazine. The foam balls 12 leave the drum housing 20 at an exit 74 which may include four openings 76, 77, 78, 79 to receiving fasteners to mount the clip housing 26 to the drum housing 20.

It has been found that for the foam balls of the size range mentioned above, the drum housing may have a length of about 133.2 mm, an outer diameter of 53.1 mm, a helical diameter of about 77.3 mm and a helical path pitch of about 24.9 mm. In the alternative, the drum housing may be lengthened or enlarged as a function of the desired foam ball capacity and/or of the size of the spherical projectiles being used.

Figure 17:
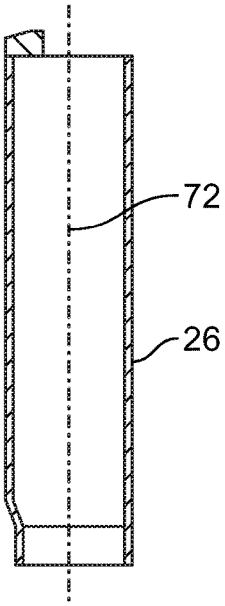
FIG. 17 is cross section view taken along line 17-17 of FIG. 6.

The clip housing 26, FIG. 6, often referred to as a 'clip' because it fits inside a gun or launcher, may be formed as an elongated, tubular housing having an internal diameter slightly larger that the diameter of the foam ball 12 being used and forming the linear path 72, FIG. 17. The clip housing 26 is connected at the front end portion 32 of the drum housing 20 at the exit 74. It may now be understood that the foam balls are able to follow a single, smooth continuous pathway made up of the helical path 52, the transition path 70 and the linear path 72 when moving through the magazine. Upon leaving the clip housing 26, the foam balls may be sequentially inserted into a firing chamber of a launcher, such the abovementioned Nerf Rival Apollo XV-700. The clip housing 26 is designed to plug into a handle of the Rival brand launchers.

At an output end 80 of the clip housing 26 is a closure 82 so that the foam balls 12 and the articulated balls 46 do not fall out of the magazine when the magazine is handle before insertion into a launcher. It has been found that the clip housing ought to be about 179.3 mm in length. As with the drum housing, dimensions may be altered as a function of ball size and/or launcher size.

Figure 14:
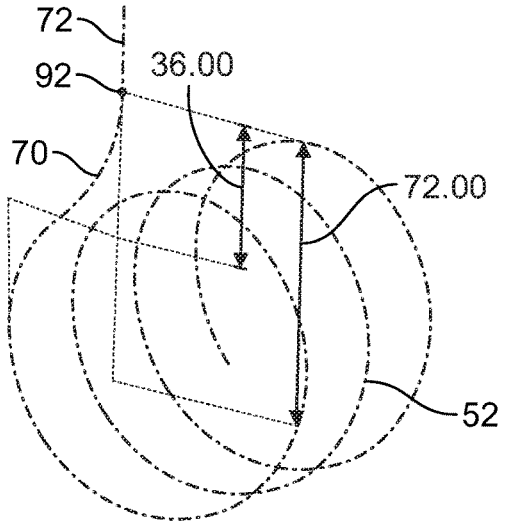
FIG. 14 is a diagrammatic isometric view of the centerline path shown in FIG. 13, and illustrating an end point of the transition portion of the path.
Figure 15:
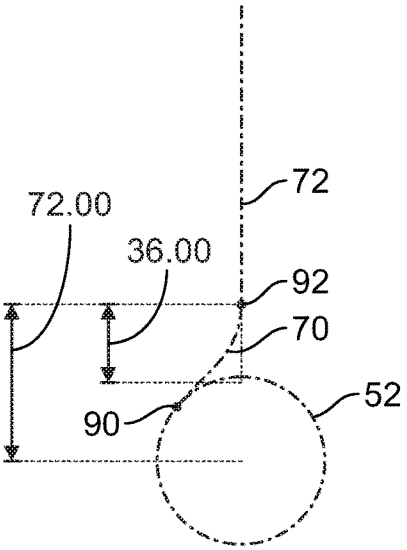
FIG. 15 is a diagrammatic elevation view of the centerline path shown in FIGS. 13 and 14, and illustrating the start and end points of the transition portion of the path.
Figure 16:
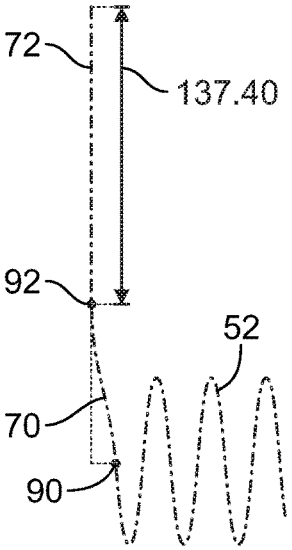
FIG. 16 is a diagrammatic elevation view taken orthogonally to the view shown in FIG. 15, of the centerline path shown in FIGS. 13-15, and illustrating the start and end points of the transition portion of the path.

As mentioned above, a major problem with launchers that fire or discharge soft foam projectiles or paint balls is that such projectiles are flexible and may distort within the magazine causing a jam with another projectile and/or with a component of the magazine. To alleviate this problem it has been found that a smooth path for the foam balls 12 within the configurations of the drum and clip housings are important. It has also been found that using a CAD program commercially available under the brand, SOLIDWORKS®, from Dassault Systemes of Velizy-Villacoublay, France and of Waltham, Mass., United States, for developing a transition path from the helical path 52, FIGS. 9, and 12-16, to the linear path 72, FIG. 17, may be obtained by creating a start point and an end point for the curve. It has been discovered that using a start point 90, FIG. 13, having x, y, z coordinates (38.65, 0, 87.47) and an end point 92, FIG. 14, having x, y, z coordinates (0, 72.0, 98.23) produces a preferable smooth curve that defines the transition path 70 as illustrated in mutually orthogonal views, FIGS. 15 and 16.

Figure 7:
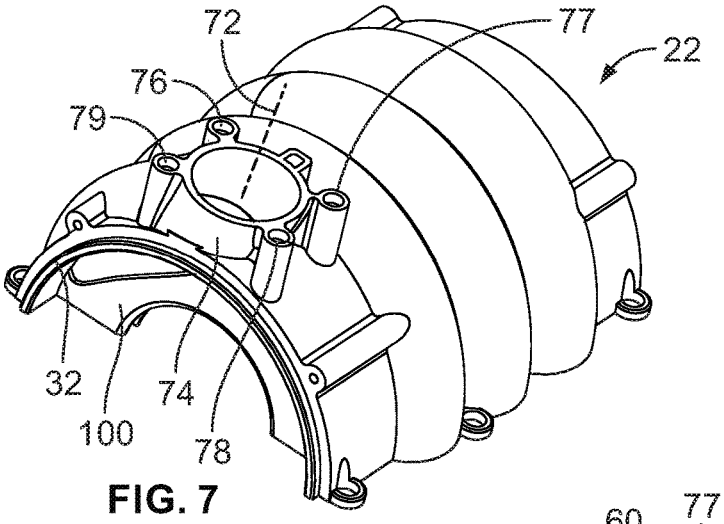
FIG. 7 is an isometric view of an upper part of a drum housing shown in FIGS. 1-3.
Figure 8:
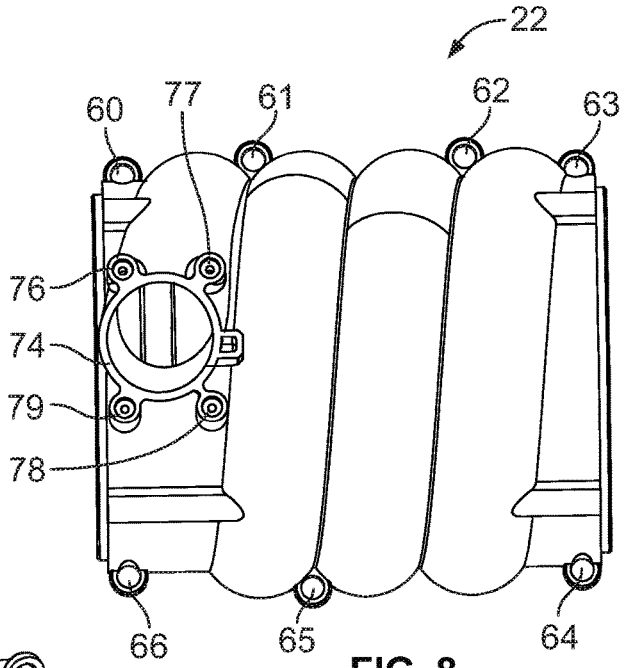
FIG. 8 is a top plan view of the upper part of the drum housing shown in FIG. 7.
Figure 18:
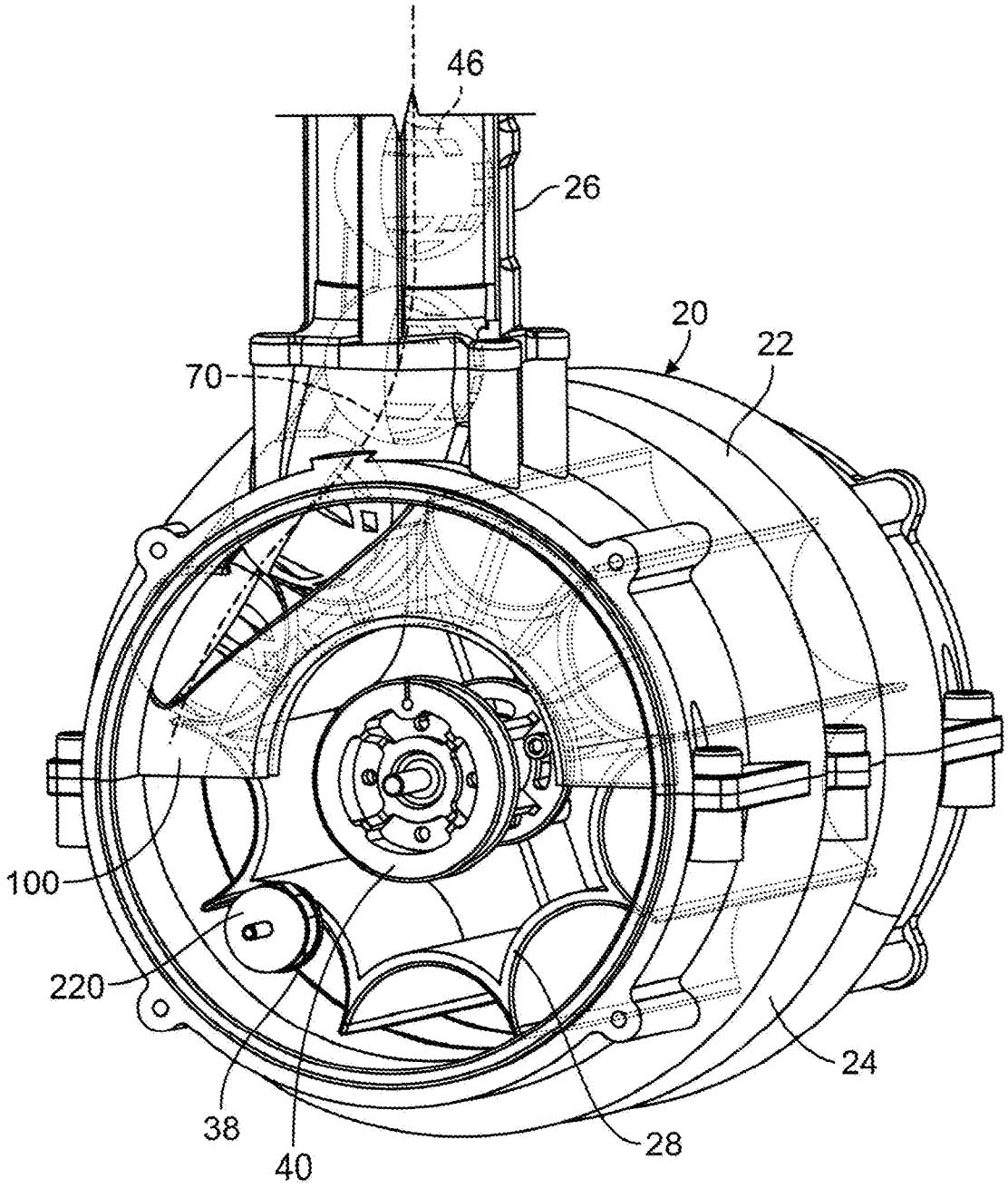
FIG. 18 is an isometric view of a portion of the magazine shown in FIGS. 1-3, with a front cover removed and illustrating a curved flange in the transition path.
Figure 19:
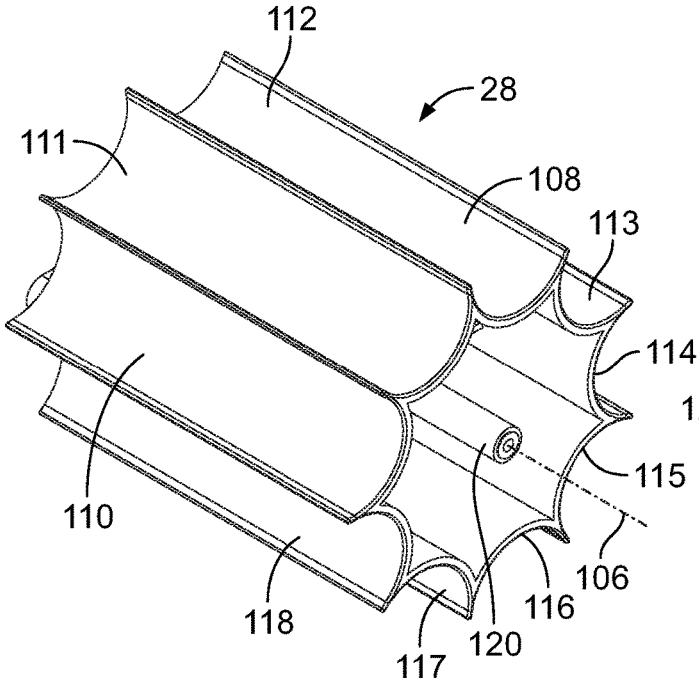
FIG. 19 is a front isometric view of a delivery and storage cylinder of the magazine shown in FIGS. 1-3.
Figure 20:
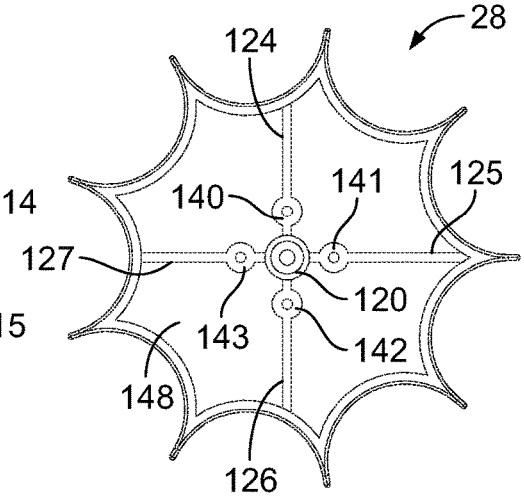
FIG. 20 is a front elevation view of the delivery and storage cylinder shown in FIG. 19.
Figure 21:
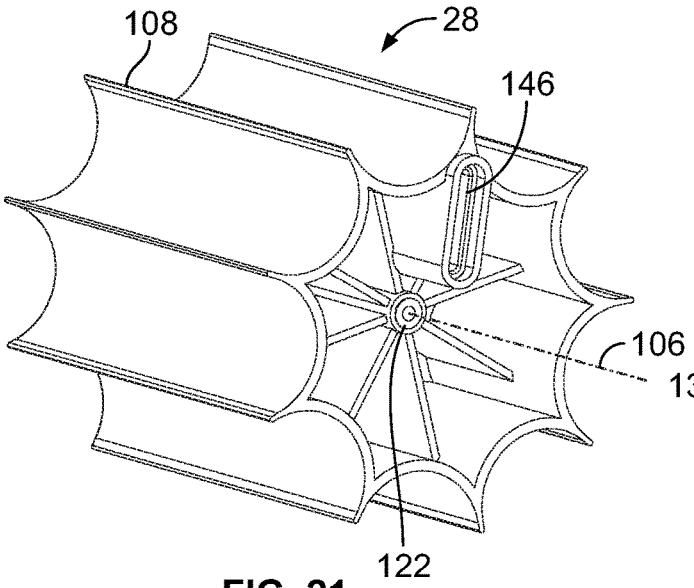
FIG. 21 is a rear isometric view of the delivery and storage cylinder shown in FIGS. 19 and 20.
Figure 22:
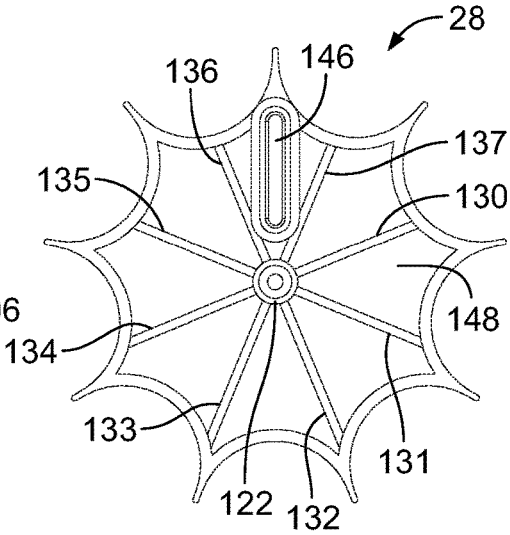
FIG. 22 is a rear elevation view of the delivery and storage cylinder shown in FIGS. 19-21.

To facilitate movement of the balls 12 along the transition path 70, a curved flange 100, FIGS. 7, 9 and 18, is mounted internally of the upper shell 22 of the drum housing 20. Referring to FIG. 18, the articulated balls 46 are illustrated passing through the transition path 70 guided by the curved flange 100. Below, the term 'dummy balls 46' may be used to refer to the plurality of articulated balls. An additional part 96, FIG. 4, may be attached to a modified drum housing 98 where the additional part may include the transition path. This offers the prospect of designing different transition paths for different projectiles.

The delivery cylinder 28, FIGS. 19-22, also referred to as a 'sprocket 28', is rotatably mounted within the drum housing 20 on front and rear axles 102, 104, FIG. 6. The sprocket 28 is shaped generally as a cylinder with a central axis 106, and an outer shell 108 of parallel, elongated flutes, grooves or recesses 110, 111, 112, 113, 114, 115, 116, 117, 118 extending parallel to the central axis 106. The axles 102, 104 are mounted in shafts 120, 122, FIGS. 19-22, at the front and rear of the sprocket 28. Extending between the shafts 120, 122 and the outer shell 108 are reinforcing spokes, four spokes 124, 125, 126, 127 at the front of the sprocket 28 and eight spokes 130, 131, 132, 133, 134, 135, 136, 137 at the rear. Also at the front of the sprocket 28 are four screw openings 140, 141, 142, 143 to be used for fastening the pulley 40. At the rear of the sprocket 28 is a radially directed slot 146 for receiving the slider 42. An internal wall 148 separates the front spokes from the rear spokes of the sprocket 28.

Figure 23:
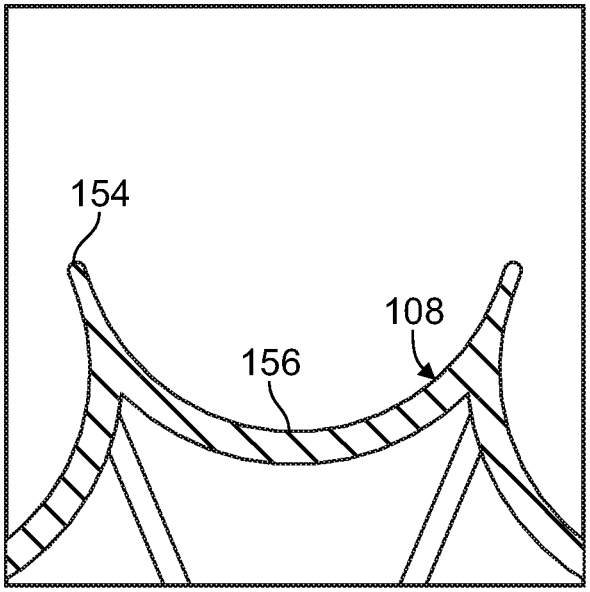
FIG. 23 is an enlarged elevation view of a flute of the delivery and storage cylinder shown in FIGS. 19-22.
Figure 24:
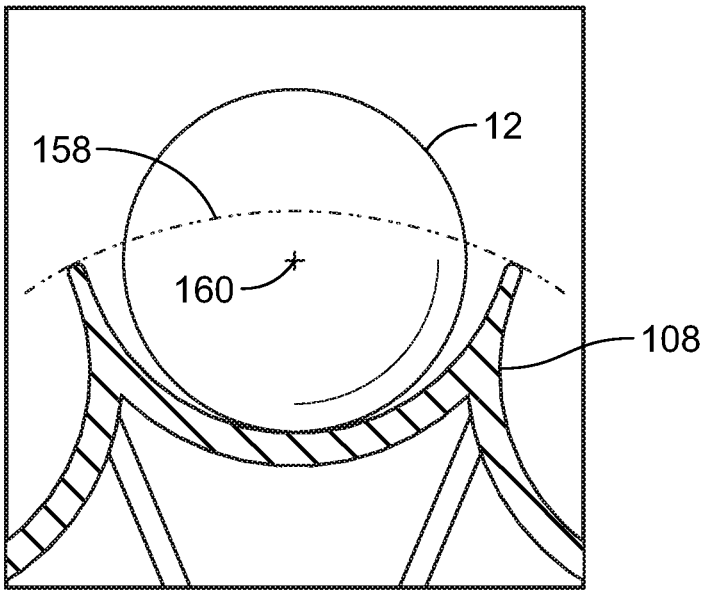
FIG. 24 is an elevation view of the flute shown in FIG. 23, supporting a foam ball.

The fluted shell 108 of the delivery cylinder 28 functions to store and feed the foam balls 12 from a rear portion 150, FIG. 6, of the sprocket 28 to a front portion 152 as the foam balls 12 travel along the helical and transition paths 52, 70 of the drum housing 20. The length of the sprocket is slightly shorter than the length of the drum housing and may have a major diameter of the flutes, at the crests 154, FIG. 23, of about 78.1 mm and a minor diameter of the flutes, at the root 156, of about 53.6 mm. It has been discovered that the depth of a flute is preferred when that dimension is slightly more than one-half of the diameter of the foam ball 12, shown in exaggerated form in FIG. 24, where the crest diameter 158 is shown above a center point 160 of the ball 12. With the dimensions mentioned above, the flute depth is about 12.25 mm. It is noted that as a ball moves from left to right, along a flute of the sprocket 28, as viewed in FIG. 1, the ball also moves under the influence of gravity between a position against the shell 108 of the sprocket 28 shown in FIG. 24, to a position against the shell 50 of the drum housing 20.

Figure 25:
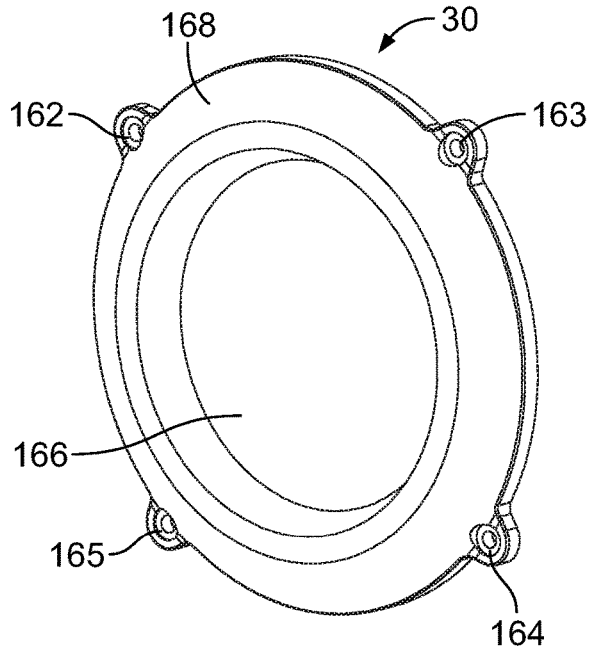
FIG. 25 is an isometric view of a front side of a front cover of the magazine shown in FIGS. 1-3.
Figure 26:
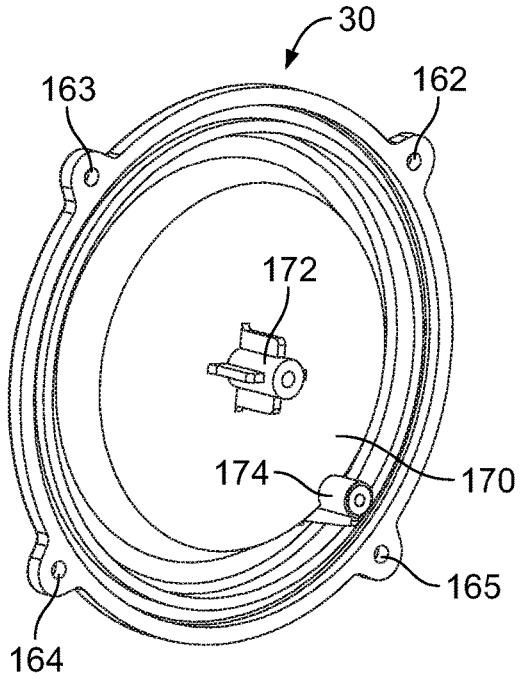
FIG. 26 is an isometric view of a rear side of the front cover shown in FIG. 25.
Figure 27:
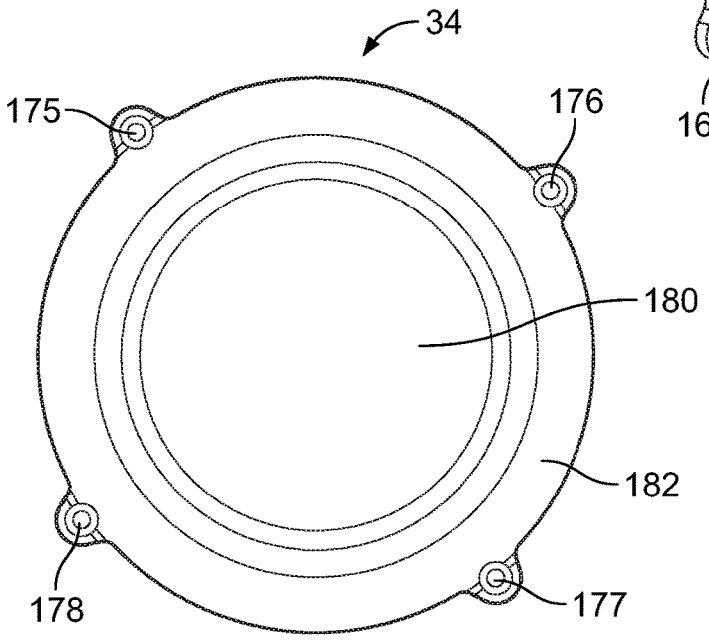
FIG. 27 is a front elevation view of a front side of a rear cover of the magazine shown in FIGS. 1-3.
Figure 28:
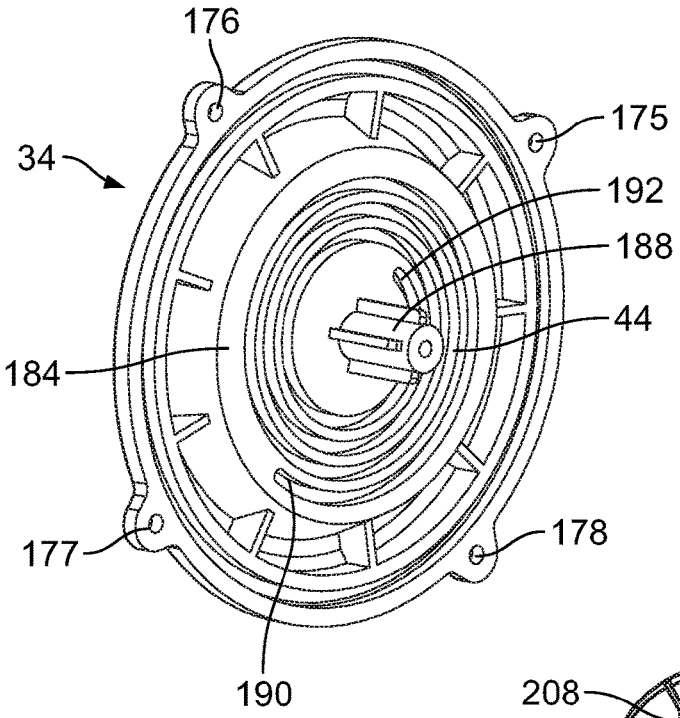
FIG. 28 is an isometric view of a rear side of the rear cover of the magazine shown in FIG. 27.

The front cover 30, FIGS. 25 and 26, may be disc shaped and is fastened to the drum housing 20 through four screws openings 162, 163, 164, 165. A peripheral attachment ring 168 surrounds a center portion 166 of the front cover 30. An inner surface 170 of the front cover 30 may include a central shaft 172 to support the axle 102, and a peripherally located post 174 for supporting the of the constant force spring 38. The rear cover 34, FIGS. 27 and 28, is similar to the front cover 30 and is also fastened to the drum housing by screws through four screw openings 175, 176, 177, 178. Like the front cover 30, the rear cover 34 may have a generally flat outer surface 180 surrounded by a peripheral attachment ring 182. An inner surface 184 of the rear cover 34 may include the spiral groove 44 and a centrally located shaft 188 for supporting the axle 104. The spiral groove 44 operates to move the slider 42 radially to limit the rotational movement of the sprocket 28 when the slider 42 reaches limiting ends 190, 192 of the groove 44.

Figure 29:
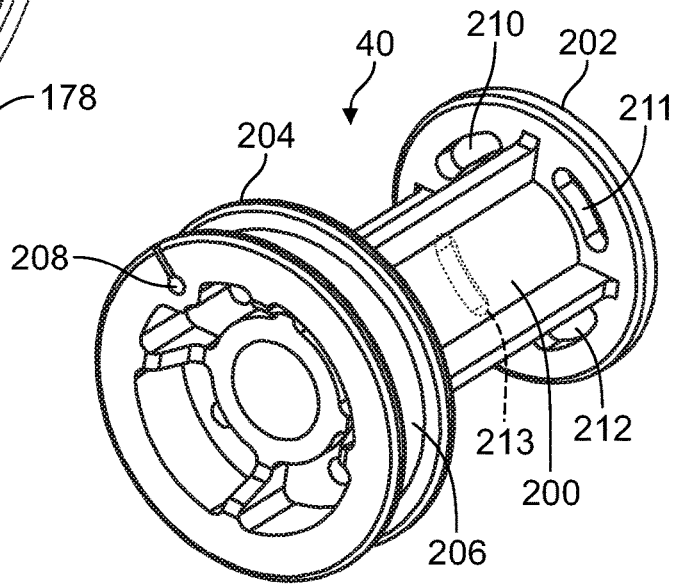
FIG. 29 is an isometric view of a pulley used in the magazine shown in FIGS. 1-3.
Figure 30:
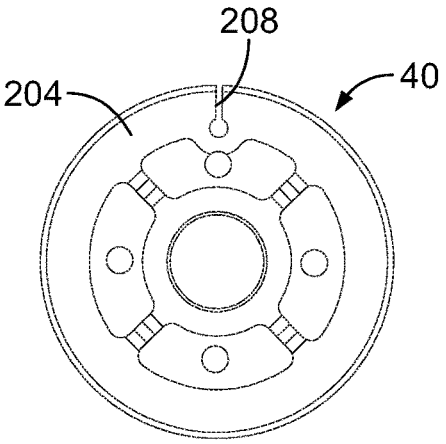
FIG. 30 is a front elevation view of the pulley shown in FIG. 29.

The pulley 40, FIGS. 29 and 30, may be generally shaped as a barbell 200 with an attachment flange 202 at one end and a pulley wheel 204 at the other end. The pulley wheel 204 includes a circumference surface 206 and a slot 208 for receiving one end of the constant force spring 38. The attachment flange 202 of the pulley 40 may be mounted to the front end of the sprocket 28 by four screws openings 210, 211, 212, 213 that align with the openings 140, 141, 142, 143, FIG. 20, in the sprocket 28. Illustrating the ease of use of the magazine, the constant force spring 38 is able to wind around the circumference surface 206 during loading of the foam balls 12 and when unwinding, the constant force spring provides the force needed to rotate the sprocket 28. As alternatives, other mechanisms may be used to cause the sprocket to rotate, such as the array of coiled springs (20, 21) in the '130 patent mentioned above, the spiral spring (17) in the '617 patent, the spiral spring (27) also disclosed in the '130 patent, the flexible arm (44) and the pusher structure (46) disclosed in the '958 patent and even a small motor and battery, well known to those skilled in the art. The pulley wheel diameter and the constant force spring may be adjusted as a function of the rotational force required.

Figure 31:
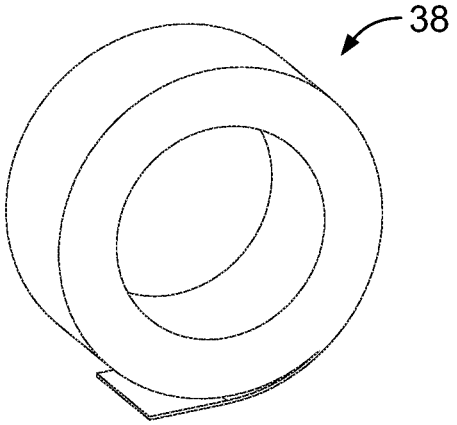
FIG. 31 is an enlarged isometric view of a constant force spring used in the magazine shown in FIGS. 1-3.
Figure 32:
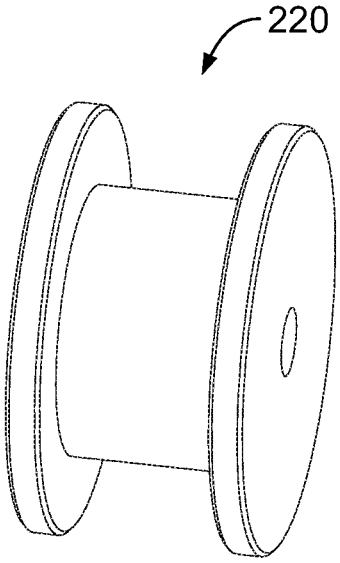
FIG. 32 is an enlarged isometric view of a spool around which the constant force spring shown in FIG. 31, is wrapped.
Figure 33:
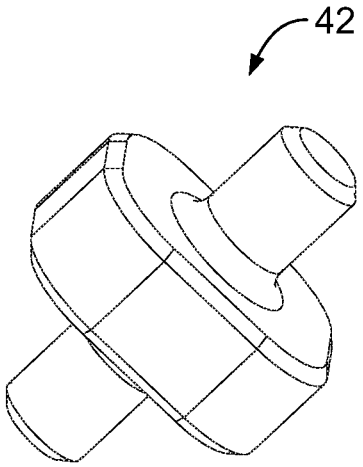
FIG. 33 is an enlarged isometric view of a slider used in the magazine shown in FIGS. 1-3.

The constant force spring 38, FIG. 31, may be wrapped around a spool 220, FIG. 32, where the constant force spring/spool combination may be mounted to the post 174, FIG. 26, on the front cover 30. The slider 42, FIG. 33, is mounted to move in the slot 146, FIGS. 21 and 22, at the rear of the sprocket 28 and functions with the spiral groove 44, FIG. 28, of the rear cover 34 as a limit stop on the rotation of the sprocket 28.

Figure 34:
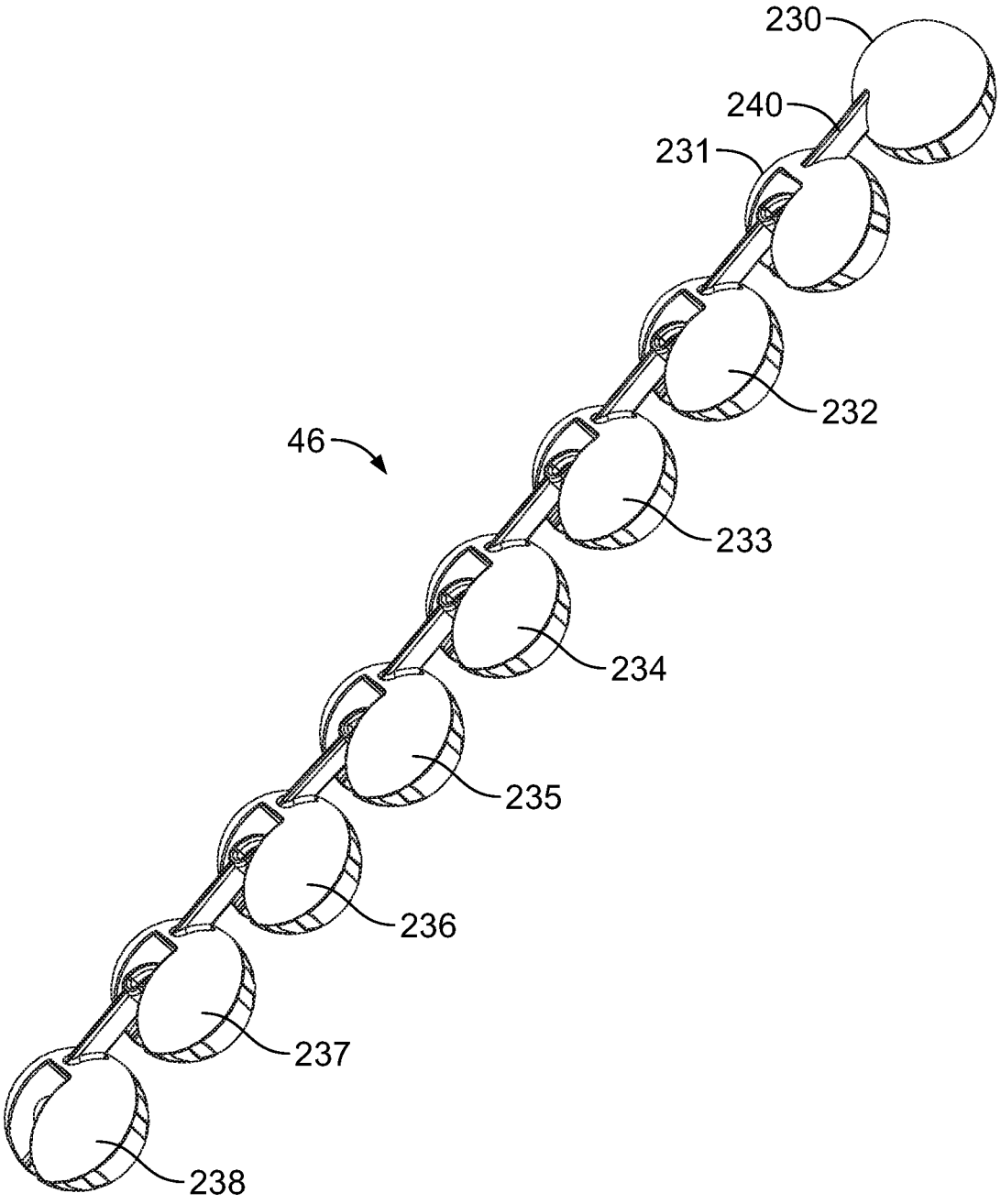
FIG. 34 is an enlarged isometric view of articulated pusher balls used in the magazine shown in FIGS. 1-3.
Figure 35:
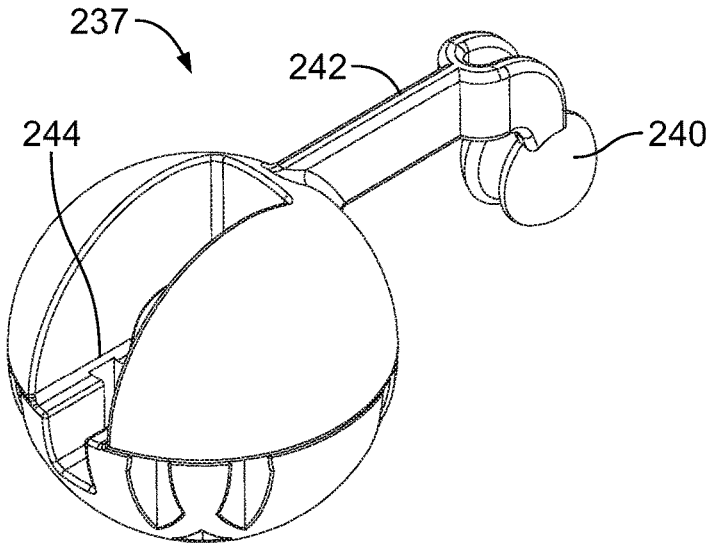
FIG. 35 is an enlarged isometric view of a pusher ball shown in FIG. 34.
Figure 36:
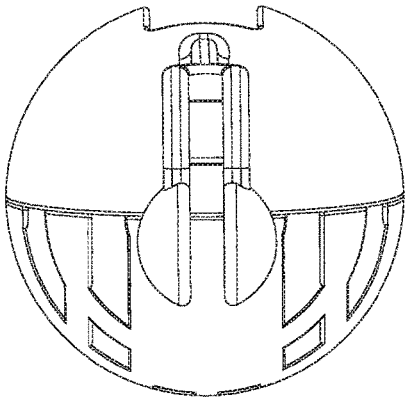
FIG. 36 is an elevation view of the pusher ball shown in FIG. 35.
Figure 37:
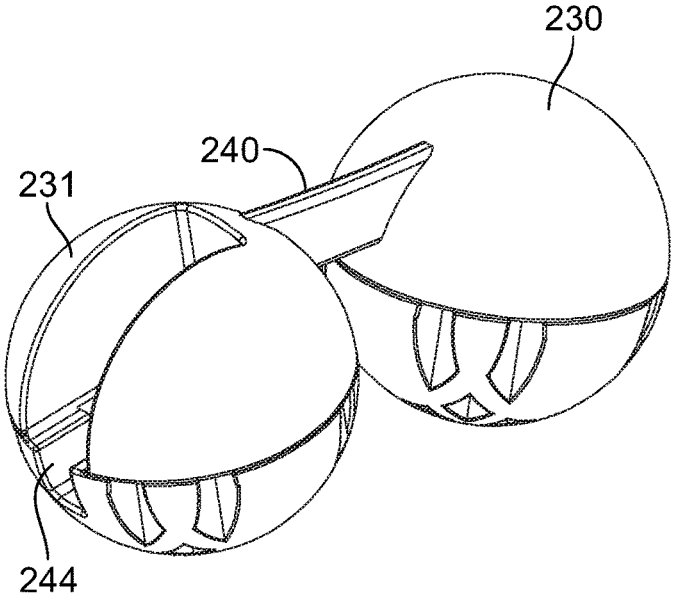
FIG. 37 is an enlarged isometric view of the leading two pusher balls shown in FIG. 34.
Figure 38:
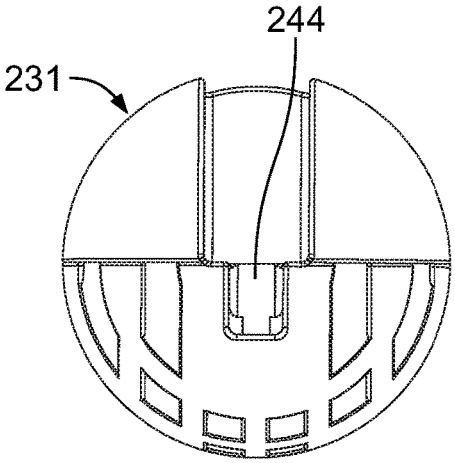
FIG. 38 is an elevation view of the pusher balls shown in FIG. 37.

The articulated balls 46, FIG. 34, sometimes referred to as a dummy chain, is mounted to move back and forth along the helical, transition and linear paths 52, 70, 72. The dummy chain 46 may include nine pivotal dummy balls 230, 231, 232, 233, 234, 235, 236, 237, 238 where the leading two dummy balls 230, 231, FIGS. 37 and 38, are fixed to one another with a bridge 240. Each of the following seven dummy balls 232, 233, 234, 235, 236, 237, 238, FIGS. 34, 35 and 36, are articulated. For example, the dummy ball 237 includes a rotatable connector 240 on an arm 242 that is received by a recess, such as the recess 244, in an adjoining dummy ball. The second dummy ball 231, FIGS. 37 and 38, also includes a connector recess 244. Each of the dummy balls has a generally spherical shape but is less flexible than the foam balls 12. Preferably each dummy ball is made of rigid plastic with a recess, an arm and a connector, except for the dummy ball 230, which is also rigid but without an arm or a connector.

Figure 39:
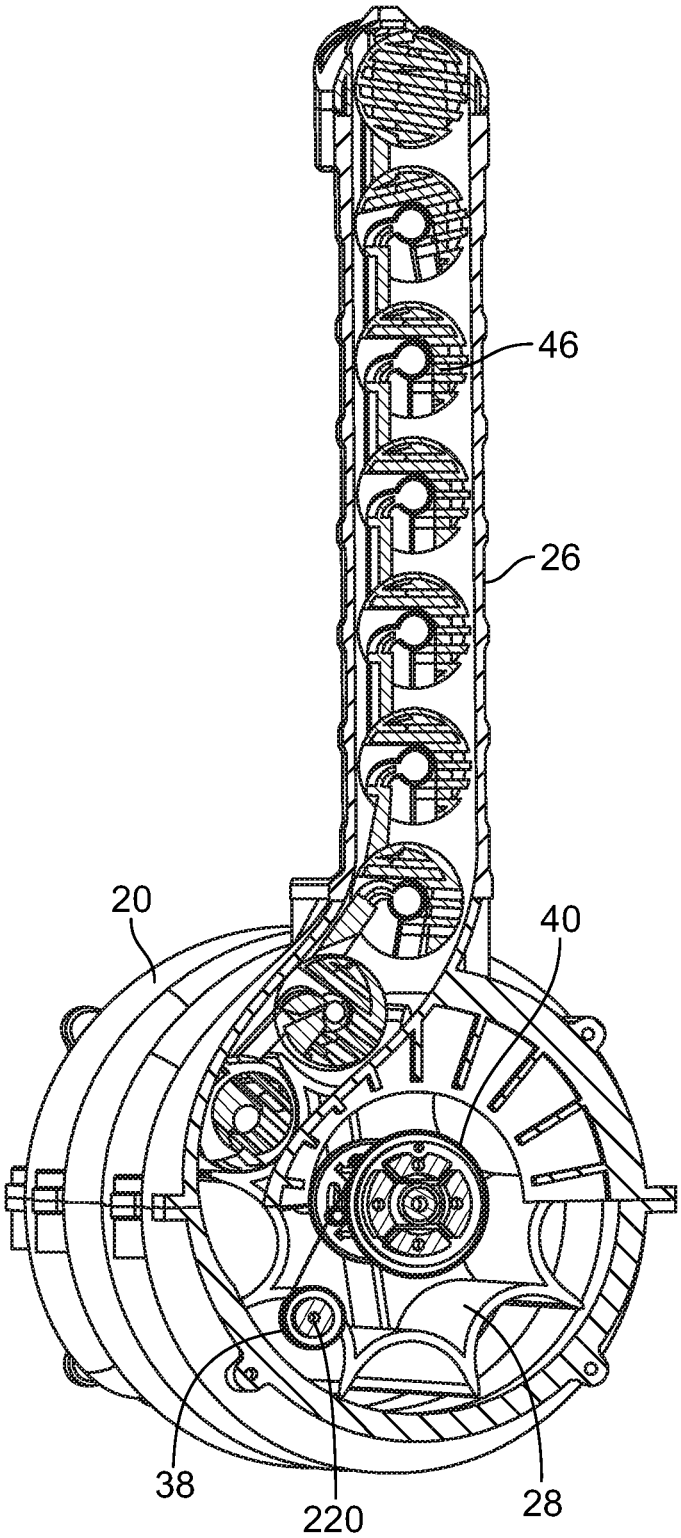
FIG. 39 is an isometric view, partially in cross section, of the magazine shown in FIGS. 1-3, illustrating the pusher balls at the end of travel of an empty magazine.

The function of the articulated balls 46, FIG. 34, is to move freely back and forth between the rear end portion of the drum housing 20 and the top 80 of the clip housing 26 while pushing loaded foam balls 12 out of the closure 82 when the magazine is feeding a launcher and when the launcher provides space for another foam ball with each trigger pull. When loading foam balls, the dummy balls 46 are moved down the linear path and along the transition and helical paths. The rotation of the sprocket 28 caused by the constant force spring 38 results in movement of the dummy chain 46 as well as the loaded foam balls, and the articulated nature of the dummy chain allows the articulated balls to follow along the helical, transitional and linear paths until the last foam ball in the magazine is received by the launcher. As illustrated in FIG. 39, the articulated balls continue to move to the top end of the clip housing 26 as the sprocket 28 rotates and the foam balls are ejected. The sprocket 28 continues to rotate until the slider 42 reaches a stop on the spiral groove 44 in the rear cover 34. Limiting rotation of the sprocket 28 ensures that the articulated balls do not inadvertently exit the clip housing along with the foam balls. When the operator loads the magazine with foam balls, the process is reversed in that the foam balls push the dummy chain rearward along the sprocket and the housings until the load capacity of thirty foam balls is reached.

Figure 40:
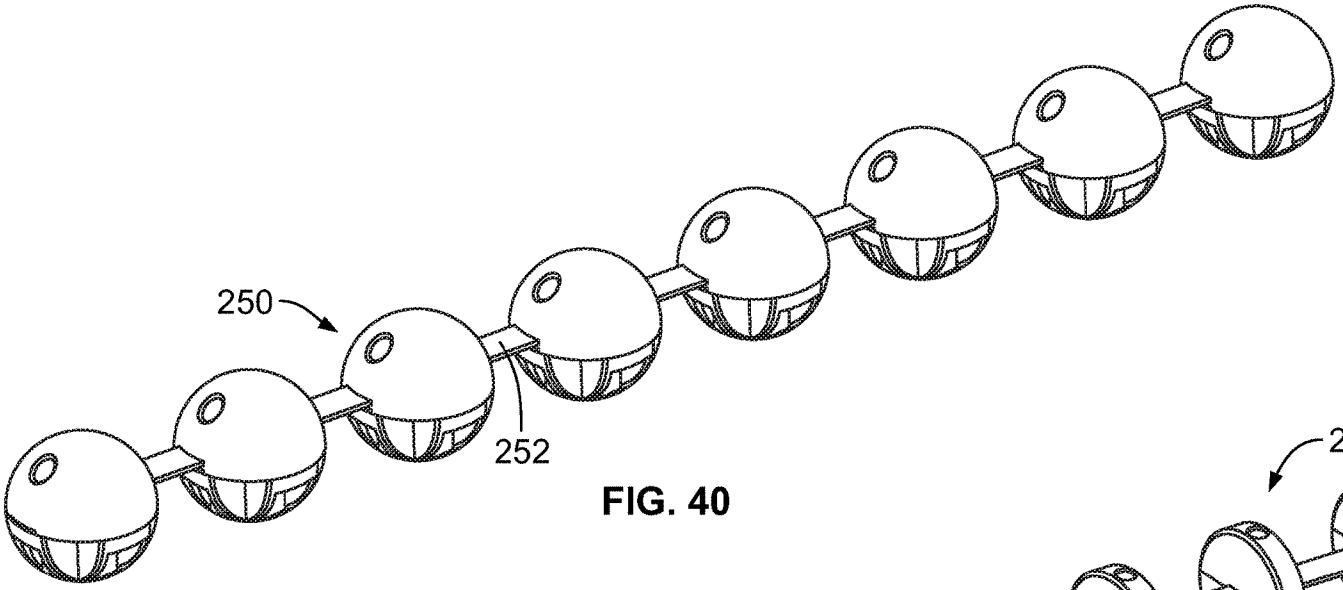
FIG. 40 is an isometric view of another embodiment of articulated pusher balls that are molded in one piece.
Figure 41:
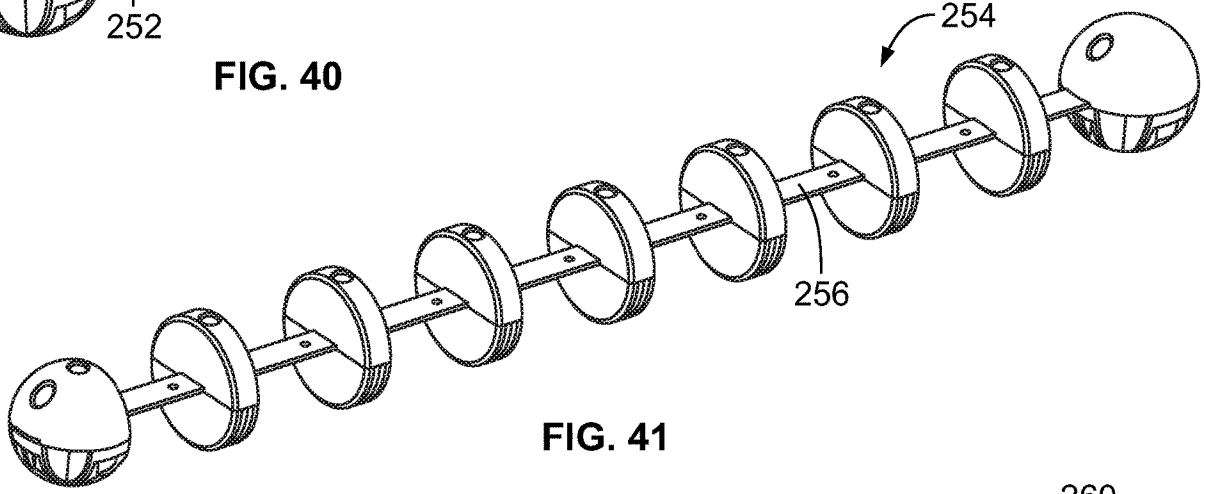
FIG. 41 is an isometric view of yet another embodiment of articulated pusher balls that are molded in one piece.
Figure 42:
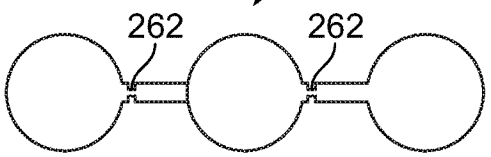
FIG. 42 is an isometric view of still another embodiment of articulated pusher balls that are molded in one piece and that include a living hinge between balls.

In the alternative, the dummy balls may be molded as a single item 250, FIG. 40, formed of polypropylene with thin flexible strips, such as the strip 252, between balls. Or, the balls may be formed as truncated discs 254 as an economy measure where flexible strips 256 are used between discs. Another alternative is illustrated in FIG. 42, where the dummy balls 260 are each separated by a living hinge 262. The living hinge allows flexing and is efficiently molded as an integral item with the dummy balls or dummy discs. Yet another alternative to prevent the dummy chain from leaving the clip housing 26 when the foam balls are expended, is to use oversize balls for the dummy chain making a departure from the clip housing much less likely if not impossible. The oversized dummy balls may be loose, with no connector between the balls, and fewer dummy balls need be used.

Figure 43:
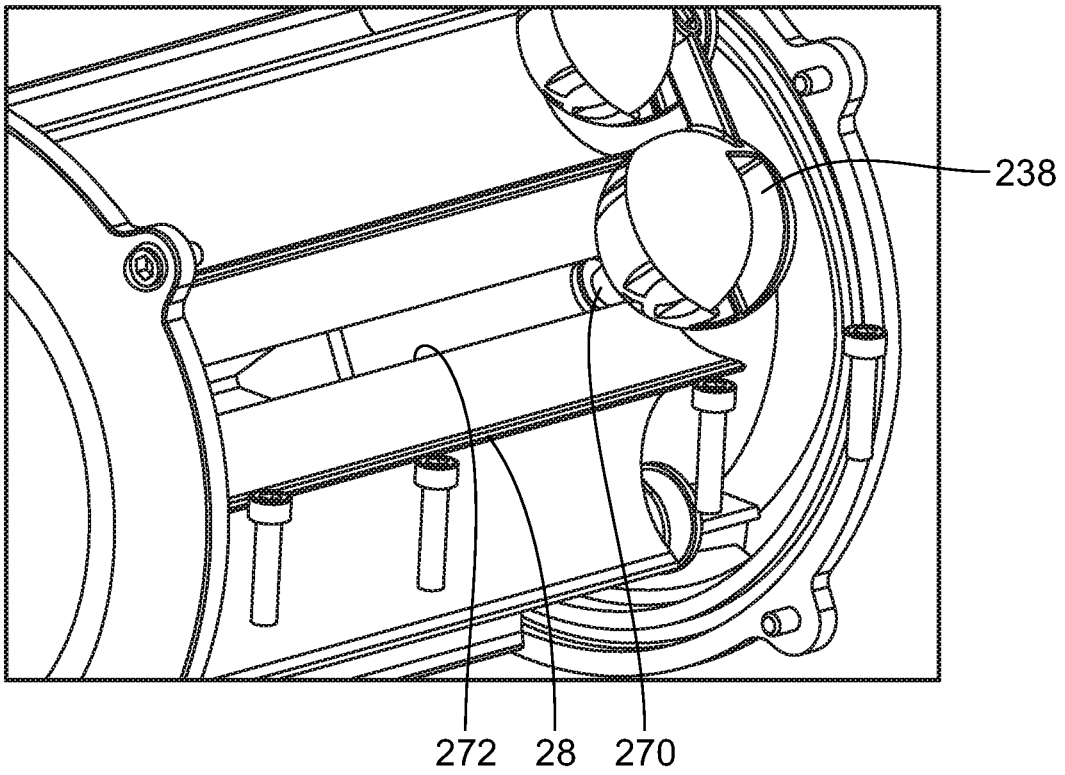
FIG. 43 is an isometric view of a portion of a drum magazine with another embodiment of articulated pusher balls showing a pusher ball having a connected t-nut inserted into a slot formed in a modified delivery and storage cylinder.
Figure 44:
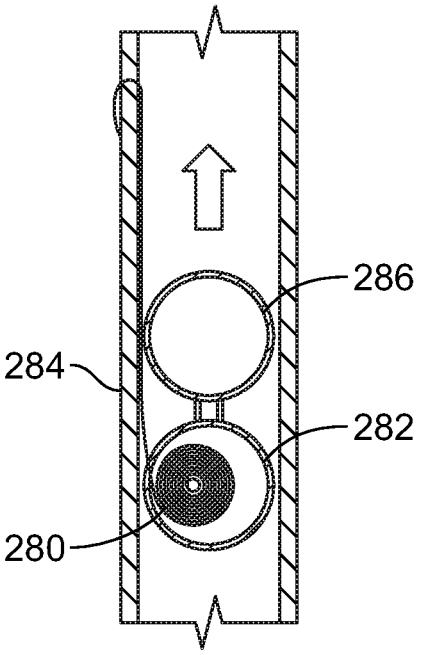
FIG. 44 is an elevation view of yet another embodiment of pusher balls attached directly to a partially unwound constant force spring.
Figure 45:
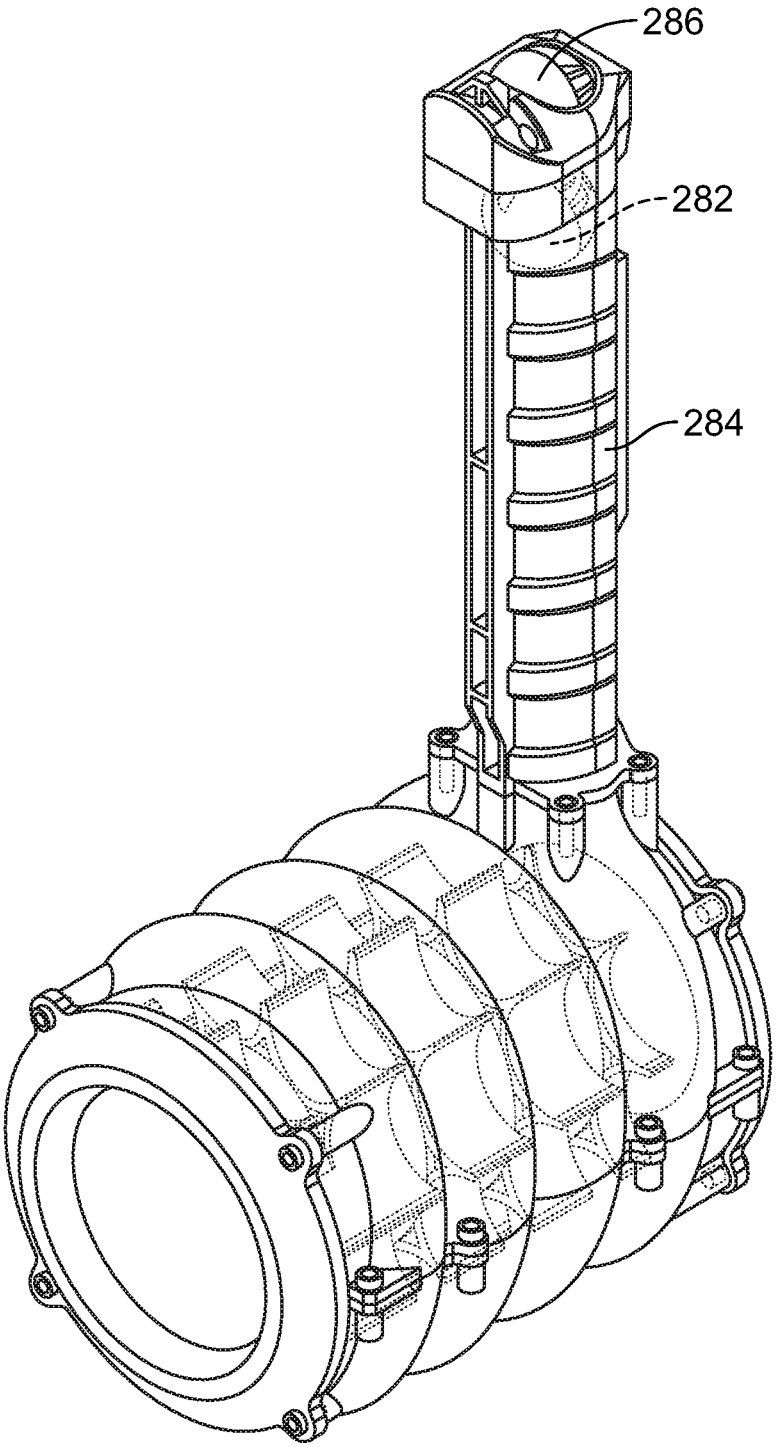
FIG. 45 is an isometric view of the embodiment of pusher balls shown in FIG. 44, where the attached constant force spring is fully wound.
Figure 46:
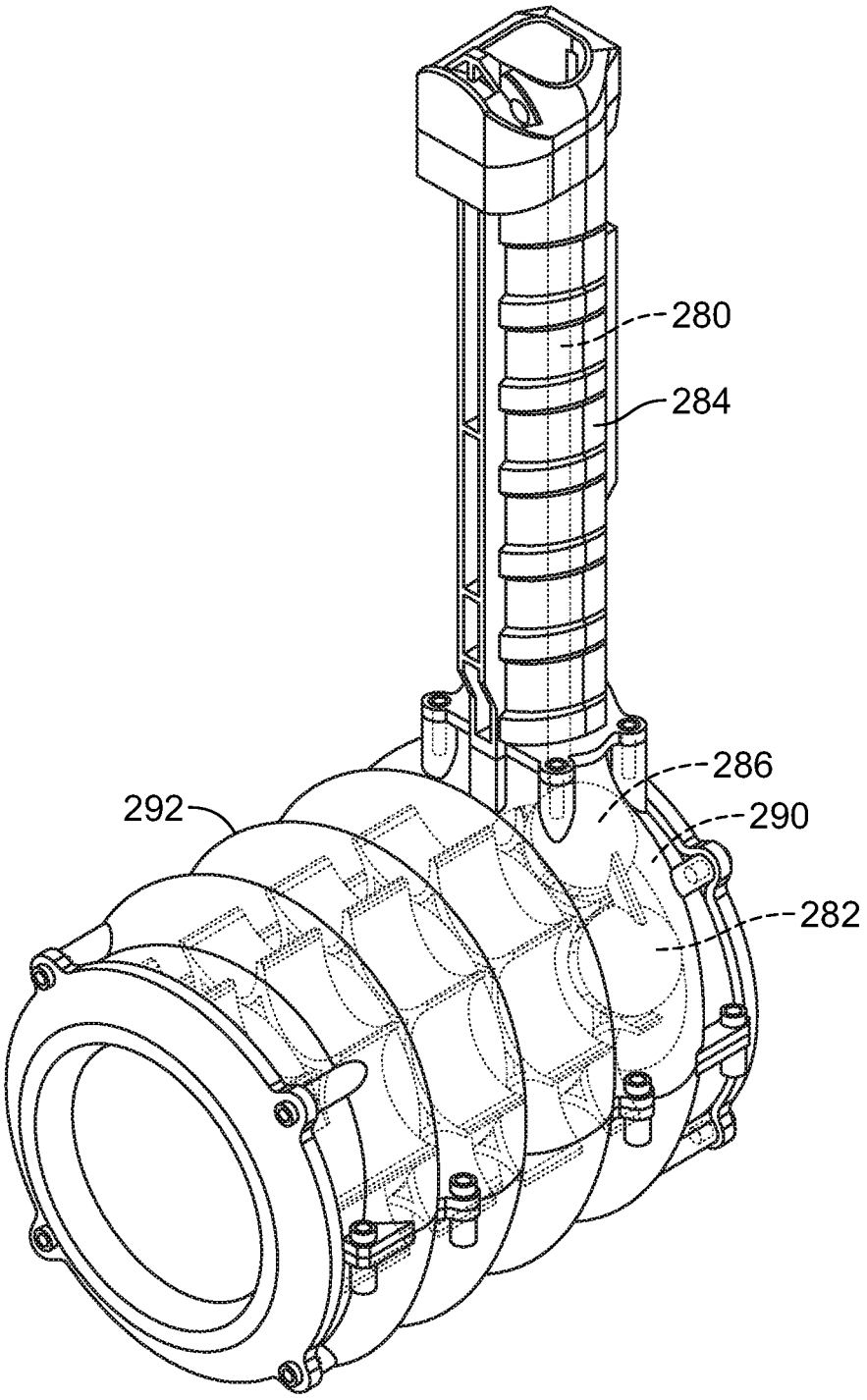
FIG. 46 is an isometric view of the embodiment of pusher balls shown in FIGS. 44 and 45, where the attached constant force spring is partially unwound.
Figure 47:
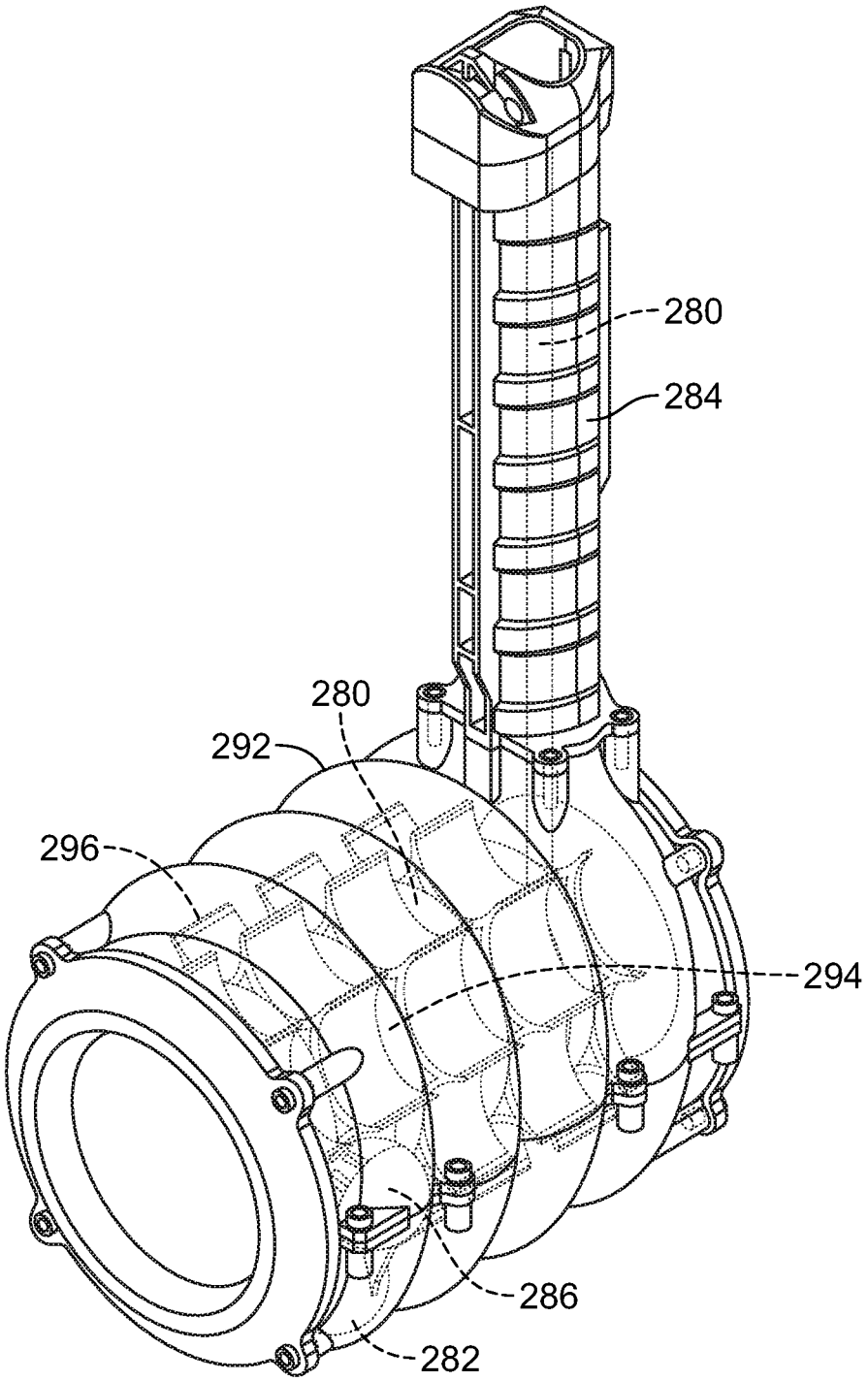
FIG. 47 is an isometric view of the embodiment of pusher balls shown in FIGS. 44-46, where the attached constant force spring is fully unwound and wrapped around another modified delivery and storage cylinder.

Still another alternative to prevent escape of the dummy chain, is to attach a small t-nut 270, FIG. 43, to last dummy ball in the chain. The t-nut engages a slot 272 in a modified sprocket and is captured. The t-nut/slot arrangement eliminates the need for the spiral groove 44 and the slider 42, but does require a fixed stop in one of the housings. A further alternative is to attach a constant force spring 280, FIG. 44, directly to a dummy ball 282 and to a tubular housing 284. Only two dummy balls 282, 286 need be used, where the upper dummy ball 286 may be needed for stability. Illustrated in FIG. 45, the two dummy balls 282, 286 are at the top of the clip housing 284 and the constant force spring 280 is fully wound. Shown in FIG. 46, the constant force spring 280 is extended to the transition region 290, and the dummy balls 282, 286 are in the transition region 290 of a drum housing 292. Illustrated in FIG. 47, the constant force spring 280 extends down the clip housing 284 and is wrapped around a spiral groove 294 formed in a modified sprocket 296.

In operation, the magazine apparatus is loaded through the top of the clip housing where each of the loaded foam balls push against the dummy balls, or against a previously loaded round, causing the dummy balls to first move along the linear path in the clip housing, down through the transition path, and then along the helical path, both in the drum housing. At the same time, the dummy balls and the foam balls cause the delivery cylinder to rotate and wind the constant force spring. When thirty foam balls have been loaded, the dummy balls reach the end of the helical path and stop indicating that the magazine is fully loaded.

Once the magazine is loaded, the operator may insert the clip housing into the handle of a launcher allowing the last loaded round to be biased into a firing position. Each time the trigger of the launcher is pulled the constant force spring biases another foam ball into the firing position.

Figure 48:
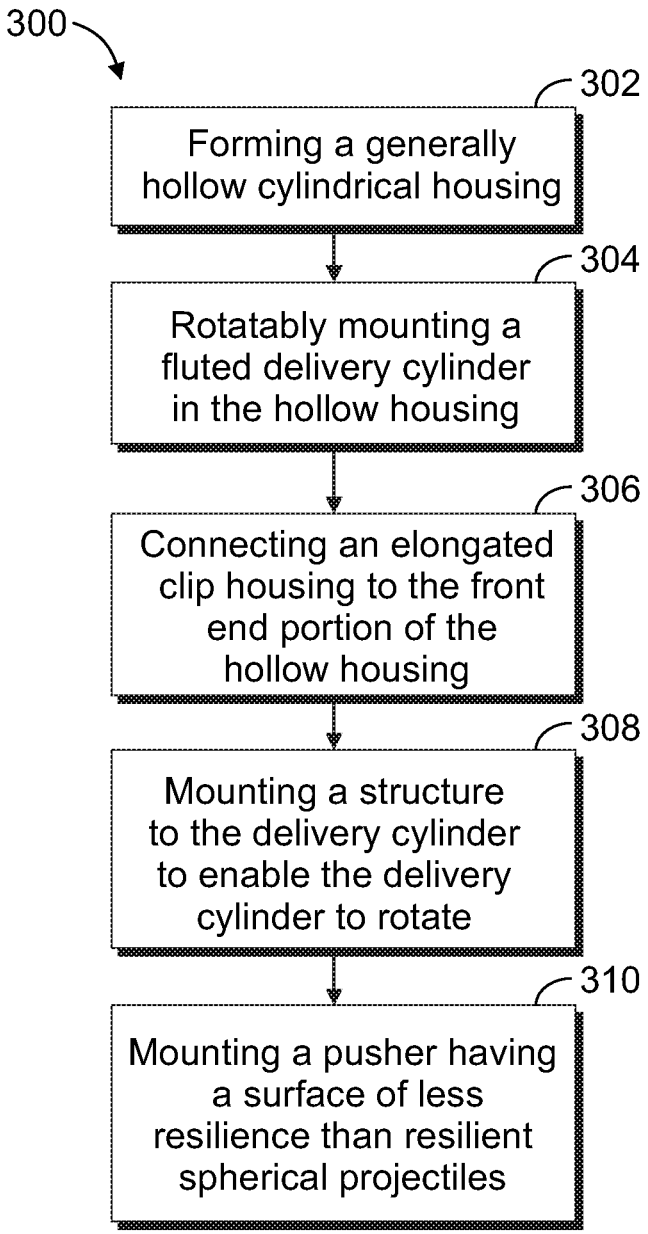
FIG. 48 is a flow diagram of a method for making a magazine for spherical projectiles.

The present invention also includes a method 300, FIG. 48 for making a high capacity magazine apparatus for flexible spherical projectiles including the steps of forming a generally hollow cylindrical housing 302 having front and rear end portions and a helically shaped shell for forming helical and transition paths for resilient spherical projectiles to follow, rotatably mounting a fluted delivery cylinder in the hollow housing 304, wherein flexible spherical projectiles moving between the front and rear end portions of the hollow housing are enabled to move along flutes of the delivery cylinder, connecting an elongated clip housing to the front end portion of the hollow housing 306, the clip housing having an internal path for spherical projectiles to enable movement of the spherical projectiles from the hollow housing to a launcher of spherical projectiles, mounting a structure, such as a constant force spring, to the delivery cylinder to enable the delivery cylinder to rotate 308, and mounting a pusher, such as the dummy chain, having a surface of less resilience than the spherical projectiles 310, the pusher being movable along the helical, transition and internal paths to enable spherical projectiles to exit the elongated cylinder.

The magazine apparatus disclosed in detail above enhances the play value of a launcher and is easy to operate. The magazine greatly increases play time by increasing magazine capacity in a robust but relatively simple structure, and that may be produced at a reasonable cost.

From the foregoing, it can be seen that there has been provided features for an improved magazine for spherical projectiles and a disclosure of a method for making the magazine apparatus. While particular embodiments and variations of the present invention have been shown and described in great detail, it will be obvious to those skilled in the art that further changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent claims as mandated by the United States Code, Title 35, Section 112, when viewed in their proper perspective based on the prior art.

What is claimed is:

1. A high capacity magazine apparatus for flexible spherical projectiles comprising:

a generally hollow cylindrical housing having front and rear end portions and a shell forming helical and transition paths for flexible spherical projectiles to follow;

a delivery and storage cylinder having multiple recesses extending parallel to a longitudinal axis of the delivery cylinder, the delivery cylinder being rotatably mounted in the hollow housing wherein flexible spherical projectiles are enabled to move along the recesses of the delivery cylinder and the path of the shell of the hollow housing from the rear end portion to the front end portion of the hollow housing;

an elongated tubular housing mounted to the hollow housing, the tubular housing having an internal path for flexible spherical projectiles to enable movement of the spherical projectiles from the hollow housing to a launcher of spherical projectiles;

a structure mounted to the hollow housing and connected to the delivery cylinder to enable the delivery cylinder to rotate; and a pusher having a surface of less flexibility than the flexible spherical projectiles movable along the helical, transition and internal paths to enable the flexible spherical projectiles to exit the tubular cylinder.

2. The high capacity magazine apparatus as claimed in claim 1, wherein:

the transition path enables moving spherical projectiles to smoothly change direction from the helical path to the internal path.

3. The high capacity magazine apparatus as claimed in claim 2, wherein:

the transition path includes a flange mounted to the hollow housing to guide spherical projectiles moving in the hollow housing.

4. The high capacity magazine apparatus as claimed in claim 1, wherein:

the structure to enable the delivery cylinder to rotate is a constant force spring.

5. The high capacity magazine apparatus as claimed in claim 1, wherein:

the pusher is a plurality of articulated rigid structures.

6. The high capacity magazine apparatus as claimed in claim 1, including:

a structure connected to the hollow housing to limit rotation of the delivery cylinder.

7. The high capacity magazine apparatus as claimed in claim 1, including:

a closure connected to the tubular housing for selectively blocking the tubular housing.

8. The high capacity magazine apparatus as claimed in claim 1, including:

front and rear covers connected to the front and rear end portions of the hollow housing; and wherein the structure to enable the delivery cylinder to rotate is a constant force spring.

9. The high capacity magazine apparatus as claimed in claim 8, wherein:

the pusher is a plurality of articulated rigid structures.

10. The high capacity magazine apparatus as claimed in claim 9, including:

a structure connected to the hollow housing and to the delivery cylinder to limit rotation of the delivery cylinder.

11. The high capacity magazine apparatus as claimed in claim 10, including:

a closure connected to the tubular housing for selectively blocking the tubular housing.

12. A high capacity magazine apparatus for flexible spherical projectiles comprising:

a drum shaped housing having front and rear end portions and a helical shaped shell for forming helical and transition paths for flexible spherical projectiles to follow between the front and rear end portions;

a fluted delivery cylinder, the delivery cylinder being rotatably mounted in the drum housing wherein flexible spherical projectiles moving between the front and rear end portions of the drum housing are enabled to move along the flutes of the delivery cylinder;

an elongated clip housing mounted to the drum housing, the clip housing having an internal path contiguous with the helical and transition paths for flexible spherical projectiles to move from the drum housing to a launcher of spherical projectiles;

a structure mounted to the delivery cylinder to enable the delivery cylinder to rotate; and a pusher of less flexibility than the flexible spherical projectiles movable along the helical, transition and internal paths to enable flexible spherical projectiles to exit the clip cylinder.

13. The high capacity magazine apparatus as claimed in claim 12, wherein:

the transition path enables moving spherical projectiles to change direction from the helical path to the internal path smoothly; and including a transition flange mounted to the drum housing.

14. The high capacity magazine apparatus as claimed in claim 13, wherein:

the structure is a constant force spring connected to the drum housing.

15. The high capacity magazine apparatus as claimed in claim 12, wherein:

the pusher includes a plurality of les flexible articulated structures having surfaces of less flexibility than the flexible spherical projectiles.

16. The high capacity magazine apparatus as claimed in claim 15, including:

a spiral groove in an end cover connected to the drum housing; and a slider mounted in a radially directed slot formed in the delivery cylinder and engaged with the spiral groove to limit rotation of the delivery cylinder.

17. A method for making a high capacity magazine apparatus for flexible spherical projectiles comprising the steps of:

forming a generally hollow cylindrical housing having front and rear end portions and a helically shaped shell for forming helical and transition paths for resilient spherical projectiles to follow;

rotatably mounting a fluted delivery cylinder in the hollow housing, wherein flexible spherical projectiles moving between the front and rear end portions of the hollow housing are enabled to move along longitudinally directed flutes of the delivery cylinder;

connecting an elongated clip housing to the front end portion of the hollow housing, the clip housing having an internal path for spherical projectiles to enable movement of the spherical projectiles from the hollow housing to a launcher of spherical projectiles;

mounting a structure to the delivery cylinder to enable the delivery cylinder to rotate; and mounting a pusher having a surface of less resilience than the spherical projectiles, the pusher being movable along the helical, transition and internal paths to enable spherical projectiles to exit the elongated cylinder.

18. The method as claimed in claim 17, wherein:

the transition path includes a flange connected to the hollow housing to provide a smooth pathway for moving spherical projectiles between the helical path and the internal path.

19. The method as claimed in claim 18, wherein:

the structure is a constant force spring.

20. The method as claimed in claim 19, wherein:

the pusher is a plurality of articulated structures having surfaces of less flexibility than the surfaces of the spherical projectiles.

21. A high capacity magazine apparatus for soft foam projectiles comprising:

a first housing having a hollow cylindrical shape, and front and rear end portions, the first housing being divided into two parts;

a second housing connected to the first housing, the second housing for mounting the magazine apparatus to a projectile launcher;

a delivery and storage structure having a generally cylindrical shape for supporting the foam projectiles, the delivery and storage structure being rotatably mounted within the first housing;

a spring connected to the first housing and to the delivery and storage structure, the spring to enable the delivery and storage structure to rotate;

a pusher for moving the foam projectiles into the projectile launcher; and a curved flange mounted in the first housing for helping form a smooth path in the first housing for movement of the foam projectiles.

22. The high capacity magazine apparatus of claim 21 including:

an axle for mounting the delivery and storage structure; and wherein:

the delivery and storage structure includes a fluted outer shell.

23. The high capacity magazine apparatus of claim 21 wherein:

the delivery and storage structure includes an outer shell having recesses extending parallel to a longitudinal axis of the delivery and storage structure.

24. The high capacity magazine apparatus of claim 21 wherein:

the curved flange forms a transition path between the first and second housings.

25. The high capacity magazine apparatus of claim 24 wherein:

the delivery and storage structure includes a fluted outer shell;

the flutes of the outer shell extend parallel to a longitudinal axis of the delivery and storage structure.

* * * * *